US010322585B2

(12) United States Patent
Okuno et al.

(10) Patent No.: US 10,322,585 B2
(45) Date of Patent: Jun. 18, 2019

(54) INKJET PRINTER

(71) Applicant: Roland DG Corporation, Hamamatsu-shi, Shizuoka (JP)

(72) Inventors: Hiroshi Okuno, Hamamatsu (JP); Naoki Ueda, Hamamatsu (JP); Yuichi Sugiyama, Hamamatsu (JP); Youichirou Ogawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/051,754

(22) Filed: Aug. 1, 2018

(65) Prior Publication Data

US 2019/0039378 A1 Feb. 7, 2019

(30) Foreign Application Priority Data

Aug. 2, 2017 (JP) ..... 2017-150156
Jun. 5, 2018 (JP) ..... 2018-107668

(51) Int. Cl.
*B41J 2/165* (2006.01)

(52) U.S. Cl.
CPC ..... *B41J 2/16505* (2013.01); *B41J 2/165* (2013.01); *B41J 2/16508* (2013.01); *B41J 2/16523* (2013.01); *B41J 2/16532* (2013.01); *B41J 2/16579* (2013.01); *B41J 2002/16555* (2013.01)

(58) Field of Classification Search
USPC ..... 347/24, 29, 30
See application file for complete search history.

(56) References Cited

U.S. PATENT DOCUMENTS 5,517,219 A * 5/1996 Uchida ..... B41J 2/16511 347/24
2003/0227505 A1* 12/2003 Tanaka ..... B41J 2/16511 347/29
2005/0275682 A1* 12/2005 Seshimo ..... B41J 2/16523 347/30
2008/0143779 A1* 6/2008 Yoshida ..... B41J 2/16523 347/30
2009/0237424 A1 9/2009 Martin et al.
2011/0050797 A1* 3/2011 Shindo ..... B41J 2/16532 347/30

FOREIGN PATENT DOCUMENTS

JP 3981502 B2 9/2007
JP 2010-221460 A 10/2010
JP 2012-035502 A 2/2012
JP 2012-228854 A 11/2012
WO 2017/029983 A1 2/2017

* cited by examiner

*Primary Examiner* — Lam S Nguyen
(74) *Attorney, Agent, or Firm* — Keating & Bennett, LLP

(57) ABSTRACT

A printer includes ink heads, an ink head conveyor, caps, a conveyor, suction pumps, opening passages, suction passages, and cap valves. The suction pumps are each provided for an associated one of the caps. The suction passages each connect an associated one of the caps to an associated one of the suction pumps. The conveyor 50 includes a base, a movable table, a guide wall, and a spring. The movable table supports the caps and includes a table wall extending upward from an end of the movable table facing in a first direction extending to a cap attaching position in a main scanning direction. The cap valves are disposed on a surface of the table wall facing in the first direction.

8 Claims, 12 Drawing Sheets

INKJET PRINTER

CROSS REFERENCE TO RELATED APPLICATIONS

This application claims the benefit of priority to Japanese Patent Application No. 2017-150156 filed on Aug. 2, 2017 and Japanese Patent Application No. 2018-107668 filed on Jun. 5, 2018. The entire contents of these applications are hereby incorporated herein by reference.

BACKGROUND OF THE INVENTION

1. Field of the Invention

The present invention relates to inkjet printers.

2. Description of the Related Art

An inkjet printer known in the related art includes an ink head provided at its nozzle surface with a plurality of nozzles and is configured to effect predetermined printing on a recording medium in an inkjet mode. Such an inkjet printer is provided with a cap unit in order to maintain discharge performance of the nozzles at a suitable level. The cap unit includes a cap to cover the nozzle surface when no printing is being effected.

The cap unit covers the nozzle surface with the cap so as to define an enclosed space between the nozzle surface and the cap. The cap unit includes a suction pump connected to the cap. The suction pump is driven, with the enclosed space defined, so that ink remaining in the nozzles is forcedly discharged to the cap. This prevents ink from solidifying in the nozzles and thus precludes clogging of the nozzles. A suction operation to discharge ink remaining in the ink head is generally referred to as "main suction".

After main suction, the suction pump is driven again, with the enclosed space exposed to atmospheric pressure, in order to discharge ink remaining in the cap unit, such as ink remaining in the cap or suction path. This makes it possible to discharge ink remaining in the cap unit without applying any excessive negative pressure to the ink head. A suction operation to discharge ink in the cap unit is generally referred to as "idle suction". A combination of main suction and idle suction may be referred to as "suction cleaning". Japanese Patent No. 3981502, for example, discloses a technique involving performing idle suction, with the cap detached from the nozzle surface, or performing idle suction after the enclosed space is exposed to atmospheric pressure through an atmospheric pressure exposure element, with the cap in intimate contact with the nozzle surface.

To meet recent demands for printers that are able to effect colorful, high-resolution printing, the number of types of ink used in each printer and the number of ink heads of each printer tend to increase. A cap unit, such as one described above, is usually provided for each ink head. Thus, an increase in the number of ink heads unfortunately increases the number of components of ink supply paths leading to the ink heads. In addition, the number of components of the cap unit also increases, resulting in an increase in size of a printer.

When a cap is detached from a nozzle surface so as to perform idle suction described above, ink discharged toward the cap may keep adhering to the nozzle surface. The ink adhering to the nozzle surface is naturally sucked into a nozzle owing to the negative pressure of an ink supply path. This may make it impossible to prevent nozzle clogging.

When two or more types of ink are supplied to a single ink head, ink adhering to the nozzle surface becomes ink of mixed colors that unfavorably contaminates the nozzle. To solve such a problem, an atmospheric pressure exposure element is desirably provided for each cap. An inexpensive atmospheric pressure exposure element, however, is likely to take up space, making it difficult to design a layout of the atmospheric pressure exposure element.

SUMMARY OF THE INVENTION

Accordingly, preferred embodiments of the present invention provide inkjet printers each including a cap unit including an atmospheric pressure exposure element without any excessive increase in overall size of the inkjet printer and that is readily adaptable to an increase in the number of ink heads.

An inkjet printer according to a preferred embodiment of the present invention includes a plurality of ink heads, an ink head conveyor, a plurality of caps, a cap conveyor, a plurality of suction devices, a plurality of cap valves, a plurality of first passages, and a plurality of second passages. The ink head conveyor moves the ink heads in a main scanning direction. The main scanning direction includes a first direction and a second direction opposite to the first direction. The caps are each detachably attachable to an associated one of the ink heads. The cap conveyor supports the caps. The cap conveyor moves the caps between a cap attaching position at which the caps are attached to the ink heads and a retracted position at which the caps are detached from the ink heads. The suction devices are each provided for an associated one of the caps. The first passages each connect an associated one of the caps to an associated one of the cap valves. The second passages each connect an associated one of the caps to an associated one of the suction devices. The cap conveyor includes a base, a movable table, a support wall, and a table urging member. The movable table supports the caps. The support wall stands vertically or substantially vertically on the base. The support wall supports the movable table such that the movable table is movable between the cap attaching position and the retracted position. The table urging member urges the movable table to the retracted position. The movable table includes a table wall extending upward from an end of the movable table facing in the first direction. The first direction is a direction extending to the cap attaching position in the main scanning direction. The cap valves are disposed on a surface of the table wall facing in the first direction.

In this preferred embodiment, the movable table of the cap conveyor includes the table wall on which the cap valves functioning as atmospheric pressure exposure elements are disposed such that the cap valves are located above the movable table supporting the caps and do not interfere with movement of the ink heads. Thus, if the ink heads and the cap valves are increased in number, this preferred embodiment would make it possible to dispose the cap valves without increasing the area occupied by the cap valves in a plan view. Consequently, this preferred embodiment provides a cap unit including the cap valves without entailing an increase in overall size of the inkjet printer.

Various preferred embodiments of the present invention provide inkjet printers each including a cap unit including an atmospheric pressure exposure element without any excessive increase in overall size of the inkjet printer and that is readily adaptable to an increase in the number of ink heads.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Inkjet printers according to preferred embodiments of the present invention will be described below with reference to the drawings. The preferred embodiments described below are naturally not intended to limit the present invention in any way. Components or elements having the same functions are identified by the same reference signs, and description thereof will be omitted or simplified if deemed redundant.

Figure 1:
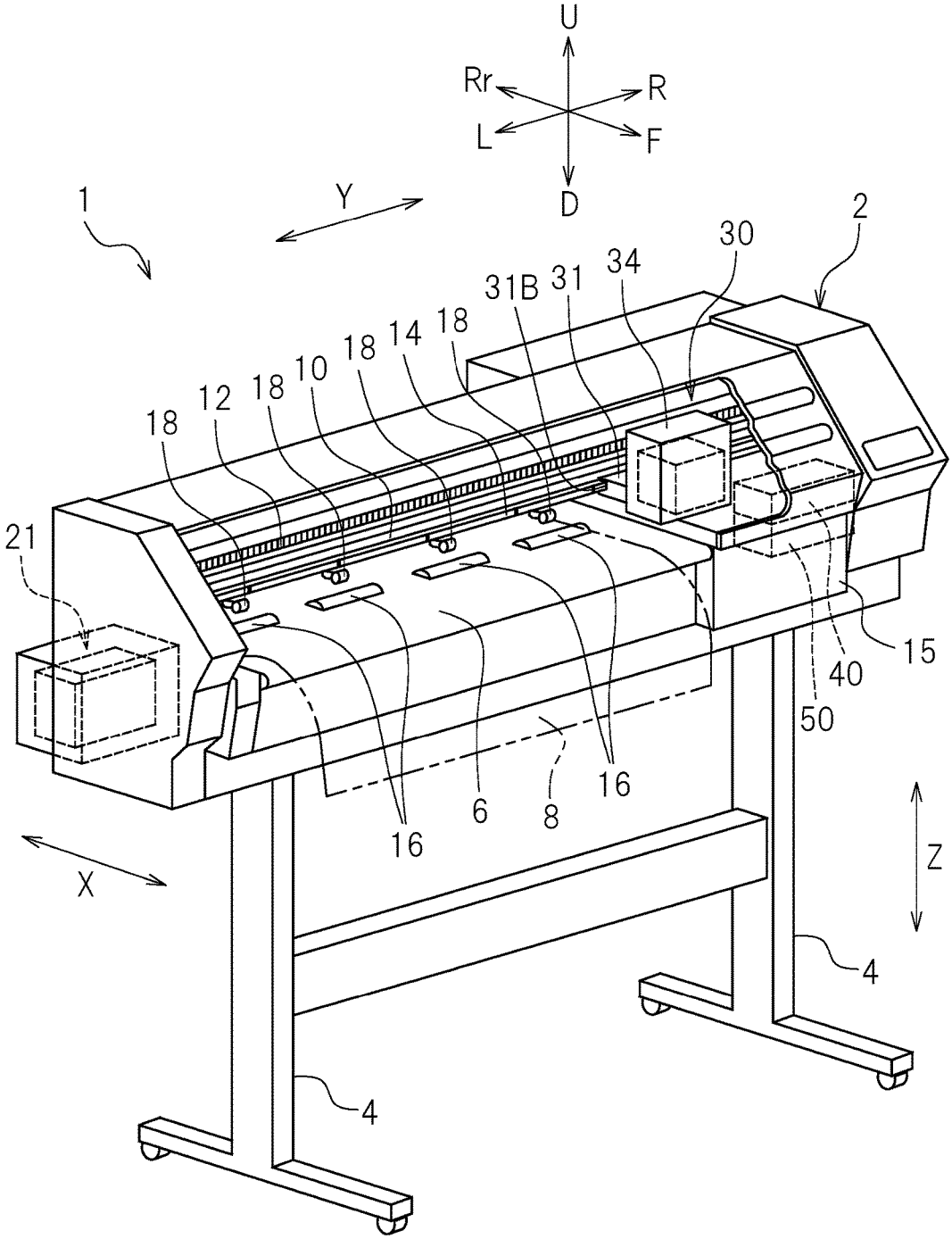
FIG. 1 is a perspective view of an inkjet printer according to a preferred embodiment of the present invention, with the inkjet printer partially cut out.

FIG. 1 is a perspective view of an inkjet printer 1 according to the present preferred embodiment. The inkjet printer 1 will hereinafter be referred to as a "printer 1". The printer 1 effects printing in an inkjet mode. As used herein, the term "inkjet mode" refers to an inkjet mode that involves techniques including various continuous methods, such as a binary deflection method and a continuous deflection method, and various on-demand methods, such as a thermal method and a piezoelectric method. In the following description, the reference signs F, Rr, R, L, U, and D in the drawings respectively represent front, rear, right, left, up, and down with respect to a user facing the front of the printer 1. The reference signs F, Rr, R, L, U, and D in the drawings may respectively represent a front side, a rear side, a right side, a left side, an upper side, and a lower side. The reference signs F, Rr, R, L, U, and D in the drawings may respectively represent a forward direction, a rearward direction, a rightward direction, a leftward direction, an upward direction, and a downward direction. The reference sign Y in the drawings represents a main scanning direction. The main scanning direction Y corresponds to a direction in which an ink head unit 30 (which will be described below) moves. In the present preferred embodiment, the main scanning direction Y is a right-left direction. The main scanning direction Y includes the rightward direction R and the leftward direction L. For the sake of convenience, the rightward direction R may be referred to as a "first direction Y1", and the leftward direction L may be referred to as a "second direction Y2". The reference sign X in the drawings represents a sub-scanning direction. The sub-scanning direction X corresponds to a direction in which a recording medium 8 is to be conveyed. The sub-scanning direction X is a direction intersecting the main scanning direction Y. In one example, the sub-scanning direction X intersects the main scanning direction Y at right angles in a plan view. In the present preferred embodiment, the sub-scanning direction X is a front-rear direction. The reference sign Z in the drawings represents a height direction. In the present preferred embodiment, the height direction Z is an up-down direction. These directions are defined merely for the sake of convenience of description and do not limit in any way how the printer 1 may be installed.

As illustrated in FIG. 1, the printer 1 is structured to effect printing on the recording medium 8. The printer 1 includes a body 2, legs 4, a guide rail 10, a cap unit 40, a conveyor 50, and a controller 100 (see FIG. 10). The body 2 is supported by the legs 4. The legs 4 are provided on the lower surface of the body 2. The front portion of the body 2 is provided with a platen 6. The recording medium 8 is placed on the platen 6.

In the present preferred embodiment, the recording medium 8 is rolled recording paper or "rolled paper". The recording medium 8, however, is not limited to rolled recording paper. The recording medium 8 may be any medium other than paper (e.g., plain paper and inkjet printing paper). Examples of the recording medium 8 include: a resin sheet or film made of polyvinyl chloride or polyester, for example; a plate material; and a fabric, such as a woven fabric or a nonwoven fabric. The recording medium 8 may be any other suitable medium. In the present preferred embodiment, a material for the recording medium 8 is not limited to any particular material.

The printer 1 includes the platen 6 on which the recording medium 8 is to be placed. The platen 6 is provided with cylindrical grit rollers 16 that define and function as components of a recording medium conveyor. The grit rollers 16 are embedded in the platen 6, with the upper surfaces of the grit rollers 16 exposed. The grit rollers 16 are driven by a feed motor (not illustrated).

The guide rail 10 is disposed above the platen 6. The guide rail 10 is disposed in parallel or substantially in parallel with the platen 6. The guide rail 10 extends in the main scanning direction Y. The printer 1 further includes a plurality of pinch rollers 18 disposed below the guide rail 10. The pinch rollers 18 are located at equal or substantially equal intervals. The pinch rollers 18 each face an associated one of the grit rollers 16. The position of each pinch roller 18 in the up-down direction Z is adjustable in accordance with the thickness of the recording medium 8. The recording medium 8 is sandwiched between each pinch roller 18 and the associated grit roller 16. Rotating the grit rollers 16 by the feed motor enables the grit rollers 16 and the pinch rollers 18 to convey the recording medium 8 in the sub-scanning direction X, with the recording medium 8 sandwiched between each grit roller 16 and the associated pinch roller 18. The grit rollers 16, the pinch rollers 18, and the feed motor are an example of the recording medium conveyor to move the recording medium 8 and the ink head unit 30 (which will be described below) relative to each other in the sub-scanning direction X.

Figure 2:
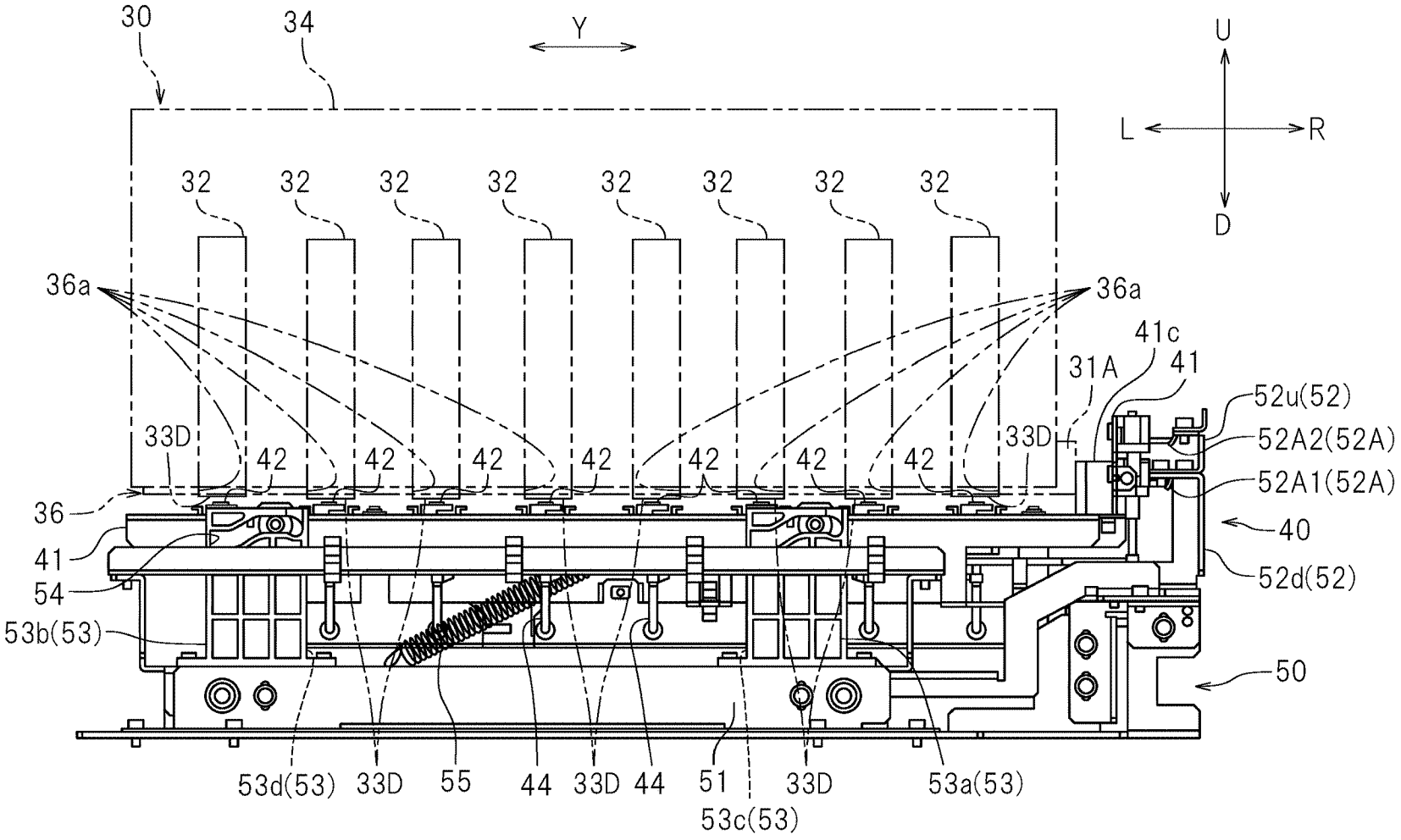
FIG. 2 is a front view of a cap unit according to a preferred embodiment of the present invention.

The printer 1 includes the ink head unit 30. As illustrated in FIG. 2, the ink head unit 30 includes ink heads 32, a case 34, a head plate 36, and a carriage 31 (see FIG. 1). To meet recent demands for printers to effect high speed, high quality printing, the number of ink heads included in each printer is increasing. The number of ink heads 32 included in the printer 1 is eight in total. The head plate 36 retains the ink heads 32. The head plate 36 is secured to the carriage 31. A region above the head plate 36 and the ink heads 32 are covered with the case 34. The case 34 is disposed on the carriage 31. An end of the carriage 31 facing in the first direction Y1 includes an engagement portion 31A that comes into engagement with the cap unit 40 (which will be described below). The back surface of a rear portion of the carriage 31 is provided with a recess 31B (see FIG. 1) recessed forward.

As illustrated in FIG. 1, the upper portion of the guide rail 10 supports a timing belt 12 extending in the main scanning direction Y. The timing belt 12 is an annular endless belt. The timing belt 12 is wound around a timing pulley and a driven pulley (which are not illustrated). The timing pulley is disposed on one of the right and left ends of the guide rail 10, and the driven pulley is disposed on the other one of the right and left ends of the guide rail 10. The timing pulley is connected to a scan motor (not illustrated). Rotating the scan motor causes the timing belt 12 to run around the timing pulley and the driven pulley. The guide rail 10 includes an engagement portion 14 protruding forward. The engagement portion 14 of the guide rail 10 and the recess 31B of the carriage 31 are in slidable engagement with each other. Running of the timing belt 12 moves the carriage 31 in the main scanning direction Y along the guide rail 10. The movement of the carriage 31 enables the ink head unit 30 to move in the main scanning direction Y along the guide rail 10. The ink head unit 30 is disposed above the platen 6, with the carriage 31 located between the ink head unit 30 and the platen 6. The guide rail 10, the timing belt 12, the timing pulley, the driven pulley, and the scan motor are an example of a carriage conveyor to move the ink head unit 30 relative to the recording medium 8 in the main scanning direction Y. The carriage 31, the carriage conveyor, and the engagement portion 31A are an example of an ink head conveyor.

As illustrated in FIG. 2, the head plate 36 is provided with through holes 36*a* through which the ink heads 32 are secured in position. The through holes 36*a* are provided in accordance with the arrangement of the ink heads 32. The ink heads 32 are disposed in the head plate 36 such that the ink heads 32 are arranged at regular intervals in the main scanning direction Y. In order to effect high-resolution printing in a short time, the present preferred embodiment involves disposing the ink heads 32 such that the ink heads 32 having the same functions are provided in pairs and the ink heads 32 of each pair are adjacent to each other and out of alignment with each other in the front-rear direction. This enables the printer 1 to effect high speed printing with a doubled print span in the sub-scanning direction X. The lower surface of each ink head 32 is a nozzle surface. The nozzle surface of each ink head 32 is provided with a large number of nozzles. Each nozzle discharges ink onto the recording medium 8. In the present preferred embodiment, the nozzle surface of each ink head 32 is provided with two nozzle rows each including a plurality of nozzles. Each nozzle row extends in the sub-scanning direction X. The nozzle surface of each ink head 32 is located below the lower surface of the head plate 36.

The printer 1 includes an ink feeder (not illustrated). The ink feeder feeds ink from ink tanks 21 to the nozzles arranged in the ink heads 32. Each ink tank 21 stores ink. The ink stored in the ink tanks 21 is fed to the ink heads 32 through ink passages (not illustrated). Each ink passage is not limited to any particular type or material. In one example, each ink passage is a flexible silicon tube. In the present preferred embodiment, the number of ink tanks 21 is equal to the number of ink heads 32. The ink tanks 21 according to the present preferred embodiment are each connected to two of the ink heads 32. A single passage connected to each ink tank 21 is split into two passages at some point. Ink stored in two of the ink tanks 21 is fed to four different nozzle rows provided in an associated pair of the ink heads 32. Thus, two different types of ink are fed to each ink head 32 from the associated two ink tanks 21. The ink tanks 21 normally store ink of different colors. Alternatively, some of the ink tanks 21 may store ink of the same color. The ink stored in each ink tank 21 is not limited to any particular color. In one example, the ink stored in each ink tank 21 may be any one of: process color ink, such as cyan ink, magenta ink, yellow ink, black ink, light cyan ink, light magenta ink, and light black ink; and spot color ink, such as white ink, metallic ink, and clear ink.

A feed pump (not illustrated) is provided at a location somewhere along each ink passage connected to the associated ink tank 21. Each feed pump sends a fluid (e.g., ink) in the ink passage from the upstream side to the downstream side. Each feed pump is provided on a portion of the associated ink passage located upstream of the point where the ink passage is split into two passages. During operation, the feed pumps send ink from the ink tanks 21 to the ink heads 32. Each feed pump is not limited to any particular type. In one example, each feed pump is a tube pump. The tube pump internally includes an inner tube and a roller. The tube pump rotates the roller in a planetary manner while the roller crushes the inner tube, so that ink is sent in the direction of travel of the roller. The tube pump may send ink from the downstream side to the upstream side by rotating the roller in a planetary manner in a reverse direction.

A portion of the ink passage located between each ink tank 21 and the feed pump is provided with a pressure control valve (not illustrated). Each pressure control valve maintains the inside of the nozzles of the associated ink heads 32 at a negative pressure when no ink is being discharged. As used herein, the term "negative pressure" refers to a pressure lower than an external pressure (which is typically atmospheric pressure). Maintaining the inside of the ink heads 32 at a negative pressure prevents ink in the ink heads 32 from trickling down to the outside through the nozzles. Each pressure control valve maintains ink in the nozzles of the ink heads 32 at about −1 kPa. Each pressure control valve includes: a passage through which ink flows; and a valve operating mechanism to open and close the passage. The valve operating mechanism opens and closes in accordance with the fluid pressure in a region downstream of the valve operating mechanism. The valve operating mechanism receives the pressure of ink upstream of the valve operating mechanism, the pressure of ink downstream of the valve operating mechanism, a mechanical force that will close the valve operating mechanism, and a mechanical force that will open the valve operating mechanism. When the printer 1 is not in use, these pressures and forces keep their balance. In such a balanced state, the valve operating mechanism seals the passage. The pressure of ink in this state is the pressure of ink at rest, which is maintained at about −1 kPa. The mechanical force that will close or open the valve operating mechanism is, for example, a restoring force of a spring. Activating a suction pump 46 sucks out ink from a region downstream of the valve operating mechanism. This reduces the pressure of ink on the downstream side so as to disturb the balance, causing the valve operating mechanism to open. Once the valve operating mechanism opens, the passage is opened so as to feed ink in the downstream direction. With such a mechanism, each pressure control valve maintains ink at a negative pressure when the printer 1 is not in use, and sends ink to the associated ink heads 32 when the printer 1 is in use.

A damper (not illustrated) is provided at a location somewhere along each ink passage connected to the associated ink tank 21. The dampers are provided immediately upstream of the ink heads 32. The dampers store ink to be sent to the ink heads 32 so as to reduce variations in ink pressure and stabilize discharge operation of the ink heads 32. Each of the dampers according to the present preferred embodiment includes: a storage chamber to store ink; and a sensor to detect the pressure of ink stored in the storage chamber. The pressure of ink stored in the storage chamber is equal or substantially equal to the pressure inside the nozzles. The sensor is an example of a detector to detect the pressure inside the nozzles. During printing, each damper keeps the pressure of ink stored in the storage chamber within a predetermined range so as to reduce variations in ink pressure. In one example, the sensor of each damper is a photosensor for position detection. One of wall surfaces of the storage chamber of each damper is a film that expands and contracts so as to deform in a concavo-convex manner in response to the pressure of ink stored in the storage chamber. The sensor of each damper detects the pressure of ink inside the storage chamber in accordance with the concavo-convex deformation of the film. When the film expands beyond a first reference position, the sensor transmits an upper limit signal to the controller 100. When the film contracts to a second reference position, the sensor transmits a lower limit signal to the controller 100. Upon receiving the upper limit signal or the lower limit signal, the controller 100 rotates the feed pump in a forward direction or a reverse direction so as to start or stop feeding ink. The pressure detector of each damper may naturally be any detector other than the sensor described above.

Figure 3:
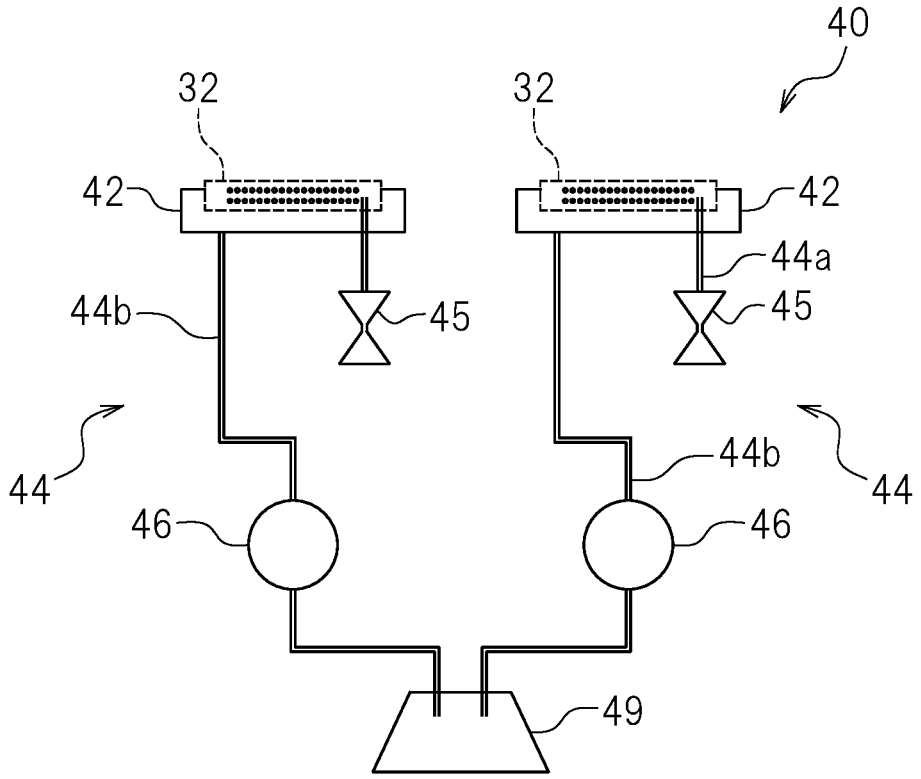
FIG. 3 is a schematic diagram illustrating ink discharge paths according to a preferred embodiment of the present invention.

As illustrated in FIG. 1, the printer 1 includes the cap unit 40. The cap unit 40 protects the ink heads 32 from drying of ink and adhesion of foreign matter when the printer 1 effects no printing. The cap unit 40 also performs suction cleaning for the ink heads 32. The cap unit 40 is disposed in a side cover 15 located rightward of the platen 6. The cap unit 40 is disposed below the ink head unit 30. FIG. 3 is a schematic diagram illustrating ink discharge paths of the cap unit 40. As illustrated in FIGS. 2 and 3, the cap unit 40 includes a movable table 41, caps 42, passages 44, cap valves 45, the suction pumps 46, a waste liquid bottle 49, and the conveyor 50.

Figure 4:
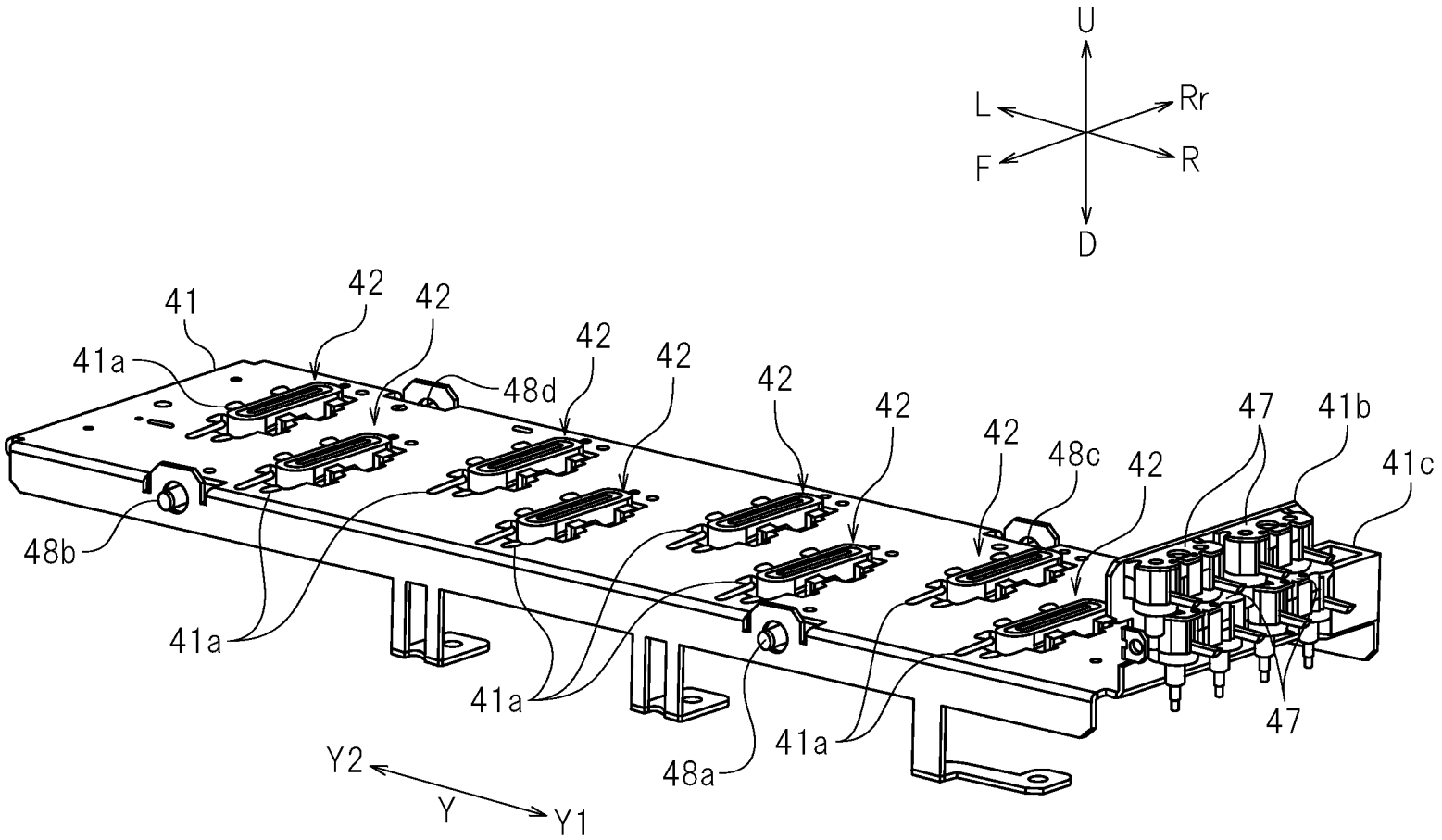
FIG. 4 is a partial perspective view of the cap unit according to a preferred embodiment of the present invention.

As illustrated in FIG. 4, the number of caps 42 included in the cap unit 40 is eight in total, for example. In other words, the number of caps 42 is equal to the number of ink heads 32. The caps 42 are basically identical in configuration. A set of the passage 44, the cap valve 45, and the suction pump 46 is provided between each of the caps 42 and the waste liquid bottle 49. The arrangements of components between the waste liquid bottle 49 and the caps 42 are substantially the same. Thus, for the sake of simplification of description, the components provided between the waste liquid bottle 49 and the caps 42 and having the same functions are identified by the same reference signs.

Each cap 42 is detachably attachable to the associated ink head 32 so as to cover the nozzle surface of the associated ink head 32. As used herein, the phrase "to cover the nozzle surface" refers to not only covering an entirety of the nozzle surface but also covering at least the nozzle rows of the nozzle surface. The caps 42 are disposed in the movable table 41. The caps 42 are each fitted into an associated one of openings 41*a* provided in the movable table 41. The movable table 41 is made of a single steel plate. The openings 41*a* are provided by punching. The openings 41*a* of the movable table 41 are provided at predetermined locations such that the arrangement of the caps 42 corresponds to the arrangement of the ink heads 32 disposed in the head plate 36. Specifically, four of the eight caps 42 are arranged at equal or substantially equal intervals in the main scanning direction Y and disposed in a relatively forward portion of the movable table 41. The other four of the eight caps 42 are arranged at equal or substantially equal intervals in the main scanning direction Y and disposed in a relatively rearward portion of the movable table 41. Each of the relatively forwardly disposed caps 42 pairs up with an adjacent one of the relatively rearwardly disposed caps 42. An end of the movable table 41 facing in the first direction Y1 includes a table wall 41*b*. The table wall 41*b* is provided by sheet metal processing. In one example, the table wall 41*b* is provided by bending, in the upward direction U, the right end of the steel plate that defines the movable table 41. An end of the movable table 41 facing in the first direction Y1 and located on the rear side Rr includes a movement stopper 41*c*. The movement stopper 41*c* comes into engagement with the engagement portion 31A (see FIG. 2) of the carriage 31 that moves in the main scanning direction Y. The lower end of the movement stopper 41*c* is secured to the upper surface of the steel plate that defines the movable table 41. A lateral surface of the movable table 41 on the front side F is provided with a guide pin 48*a* located on the right side R and a guide pin 48*b* located on the left side L. A lateral surface of the movable table 41 on the rear side Rr is provided with a guide pin 48*c* located on the right side R and a guide pin 48*d* located on the left side L. With the guide pins 48*a*, 48*b*, 48*c*, and 48*d*, the movable table 41 is supported by the conveyor 50.

Figure 5:
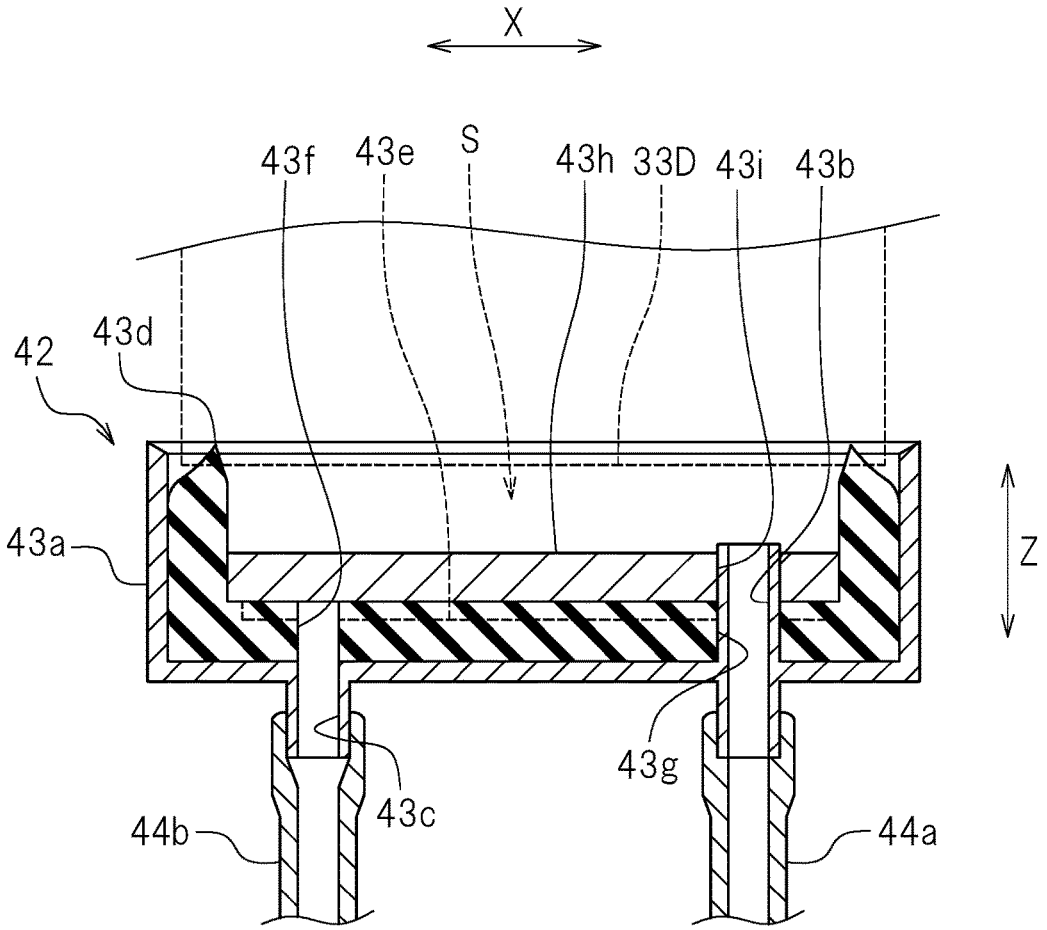
FIG. 5 is a cross-sectional view of a cap according to a preferred embodiment of the present invention, illustrating the structure of the cap.

As illustrated in FIG. 5, each cap 42 includes a body case 43*a*, a lip 43*d*, and an absorber 43*h*. Each cap 42 is detachably attachable to the associated ink head 32 so as to cover the nozzle surface of the associated ink head 32. Attaching each cap 42 to the associated ink head 32 defines an enclosed space S between each cap 42 and the nozzle surface of the associated ink head 32.

The body case 43*a* includes a bottom and a side wall. The body case 43*a* has a box shape having an upwardly facing opening. The side wall of the body case 43*a* has a shape conforming to the nozzle surface of the associated ink head 32. In one example, the side wall of the body case 43*a* has an oval shape in the plan view. The side wall of the body case 43*a* is structured such that the nozzle surface of the associated ink head 32 is fitted into the body case 43*a*. The bottom of the body case 43*a* is provided with a protrusive hole 43*b* protruding upward, and a through hole 43*c*. The lower ends of the protrusive hole 43*b* and the through hole 43*c* are each provided with a protrusion protruded in the downward direction D from the bottom of the body case 43*a* such that the protrusive hole 43*b* and the through hole 43*c* are connectable to the associated passage 44. The lower ends of the protrusive hole 43*b* and the through hole 43*c* are protruded in the downward direction D from the movable table 41. The protrusive hole 43*b* is connected with an associated one of opening passages 44*a* (which will be described below). The upper end of the protrusive hole 43*b* is located at the same height as the upper surface of the absorber 43*h* or above the upper surface of the absorber 43*h*. The upper end of the protrusive hole 43*b* is located below the upper end of the lip 43*d*. The lower end of the through hole 43*c* is connected with an associated one of suction passages 44*b* (which will be described below). The protrusive hole 43*b* defines and functions as a portion of a first passage. The through hole 43*c* defines and functions as a portion of a second passage.

The lip 43*d* is held in the opening of the body case 43*a*. The lip 43*d* includes a bottom and a side wall. The lip 43*d* is provided with an opening facing upward. The upper end of the side wall of the lip 43*d* decreases in thickness (or width) as it extends upward. The lip 43*d* is made of an elastically deformable material. In one example, the lip 43*d* is made of rubber. The lip 43*d* is provided in the body case 43*a* such that the lip 43*d* elastically comes into contact with the nozzle surface of the associated ink head 32. Bringing the lip 43*d* into contact with the nozzle surface of the associated ink head 32 defines the enclosed space S. The bottom of the lip 43*d* is provided with a through hole 43*g* and a through hole 43*f*. The protrusive hole 43*b* passes through the through hole 43*g*. The through hole 43*f* is in communication with the through hole 43*c* and the suction passage 44*b*. The upper surface of the bottom of the lip 43*d* is provided with a groove 43*e* recessed in the downward direction D. The groove 43*e* is in communication with the through hole 43*f*. The groove 43*e* extends across the entire or substantially the entire surface of the bottom of the lip 43*d*.

The absorber 43*h* is held in the opening of the lip 43*d*. The absorber 43*h* is made of an air-permeable porous material capable of absorbing ink. Examples of the porous material include a sponge, a woven fabric, and a nonwoven fabric. The absorber 43*h* includes a through hole 43*i*. The protrusive hole 43*b* passes through the through hole 43*i*. The upper surface of the absorber 43*h* is located below the upper end of the lip 43*d*. The upper surface of the absorber 43*h* is located at the same height as the upper end of the protrusive hole 43*b* or below the upper end of the protrusive hole 43*b*.

As illustrated in FIG. 3, each passage 44 includes the opening passage 44*a* and the suction passage 44*b*. As previously mentioned, the upstream end of each opening passage 44*a* is connected to the protrusive hole 43*b* of the associated cap 42, and the upstream end of each suction passage 44*b* is connected to the through hole 43*c* of the associated cap 42. The downstream end of each suction passage 44*b* is inserted into the waste liquid bottle 49. Each suction passage 44*b* connects an associated one of the caps 42 to an associated one of the suction pumps 46 (which will be described below). Each passage 44 is made of a flexible tube (e.g., a silicon tube).

Each cap valve 45 is provided at a location somewhere along the associated opening passage 44*a* or on an end of the associated opening passage 44*a*. Each cap valve 45 performs switching between an open state where the inside of the associated opening passage 44*a* is in communication with the outside of the associated opening passage 44*a* and a closed state where the inside of the associated opening passage 44*a* is out of communication with the outside of the associated opening passage 44*a*. Each cap valve 45 is not limited to any particular configuration or operating mechanism. Each cap valve 45 may be a "control valve" that switches between the open state and the closed state using at least one of water (i.e., vapor), air, electricity, magnetism, and hydraulic pressure to be supplied separately. Each cap valve 45 may be a valve that switches between the open state and the closed state by a mechanical operation. Each cap valve 45 according to the present preferred embodiment is, for example, a piston valve openable and closable by a small actuating force. The cap unit 40 includes a plurality of composite cap valves 47. Each of the composite cap valves 47 includes two of the cap valves 45 integral with each other. One of the two cap valves 45 included in each composite cap valve 47 may hereinafter be referred to as a "first cap valve 45". The other one of the two cap valves 45 included in each composite cap valve 47 may hereinafter be referred to as a "second cap valve 45". The number of composite cap valves 47 included in the cap unit 40 is four, for example.

Figure 6:
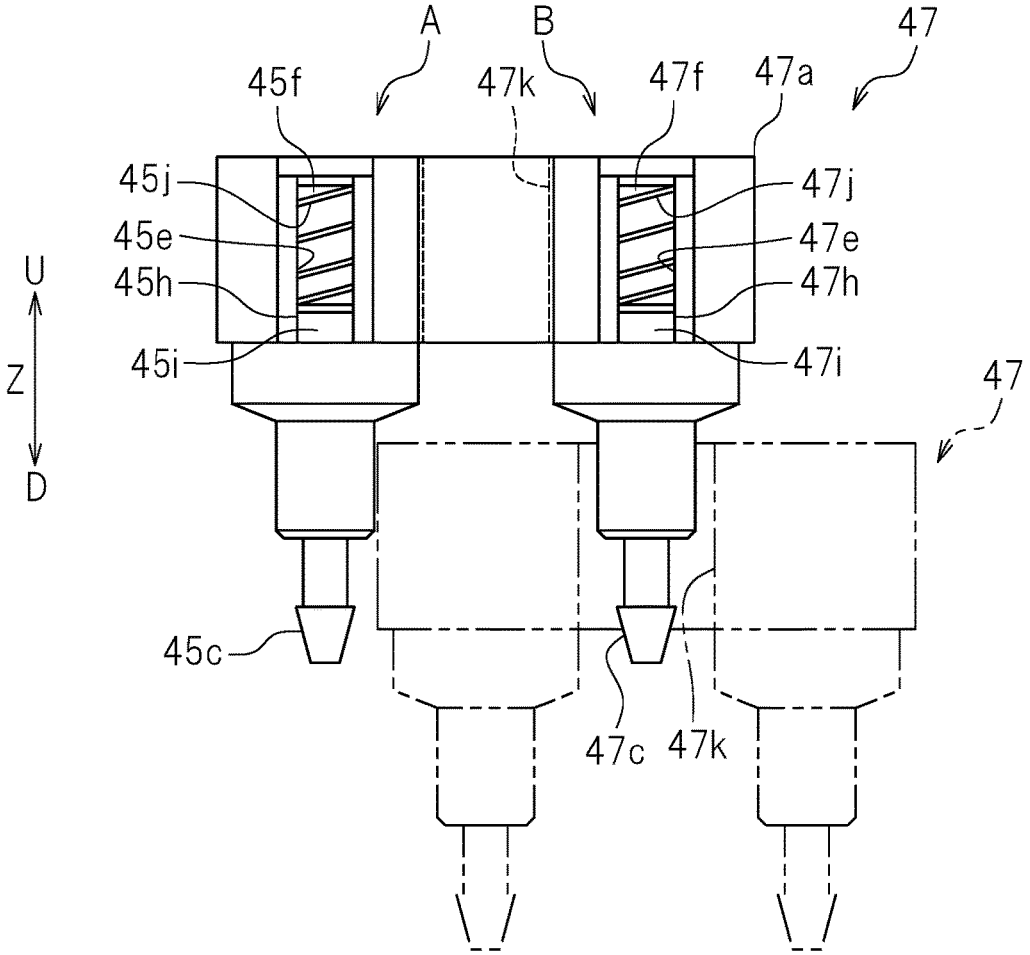
FIG. 6 is a front view of a composite cap valve according to a preferred embodiment of the present invention, illustrating the closed state of the composite cap valve.
Figure 7A:
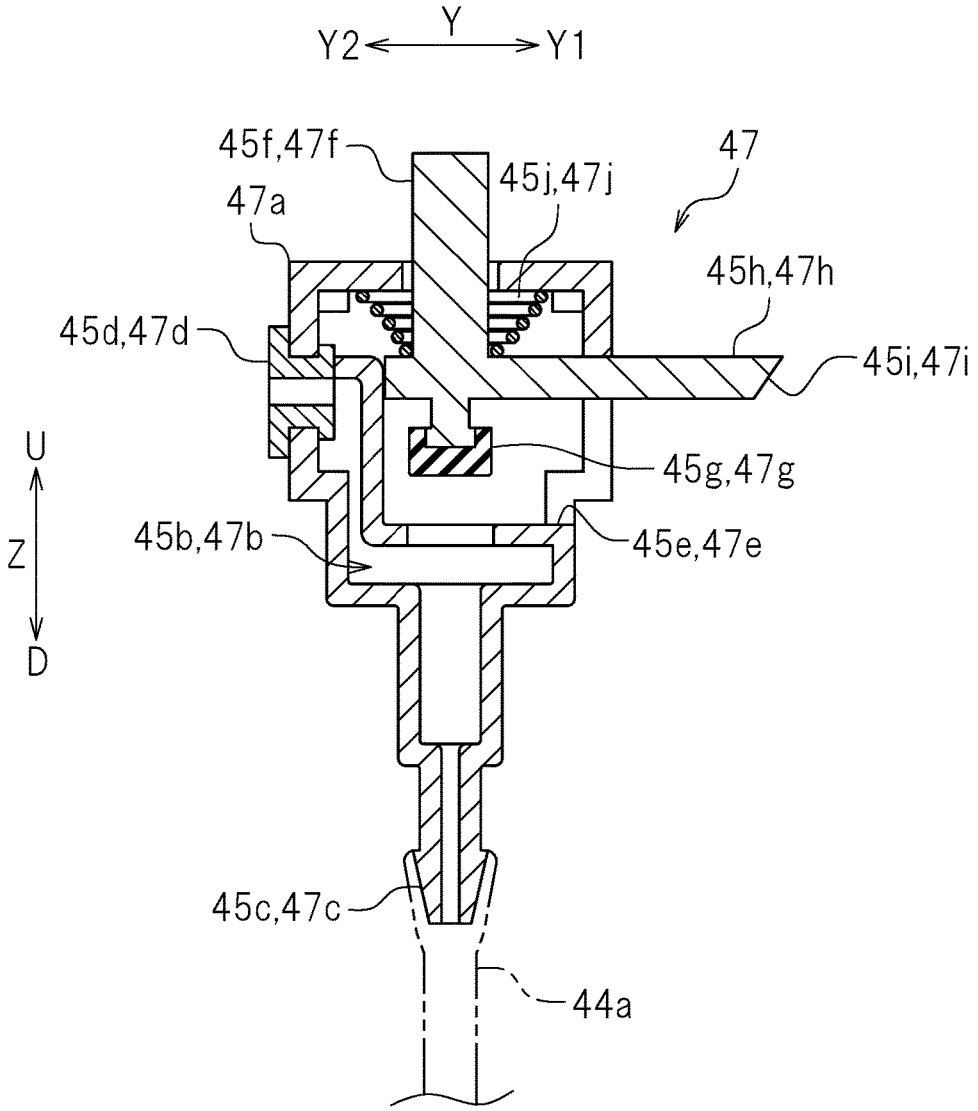
FIG. 7A is a cross-sectional view of the cap valve according to a preferred embodiment of the present invention, illustrating the open state of the cap valve.
Figure 7B:
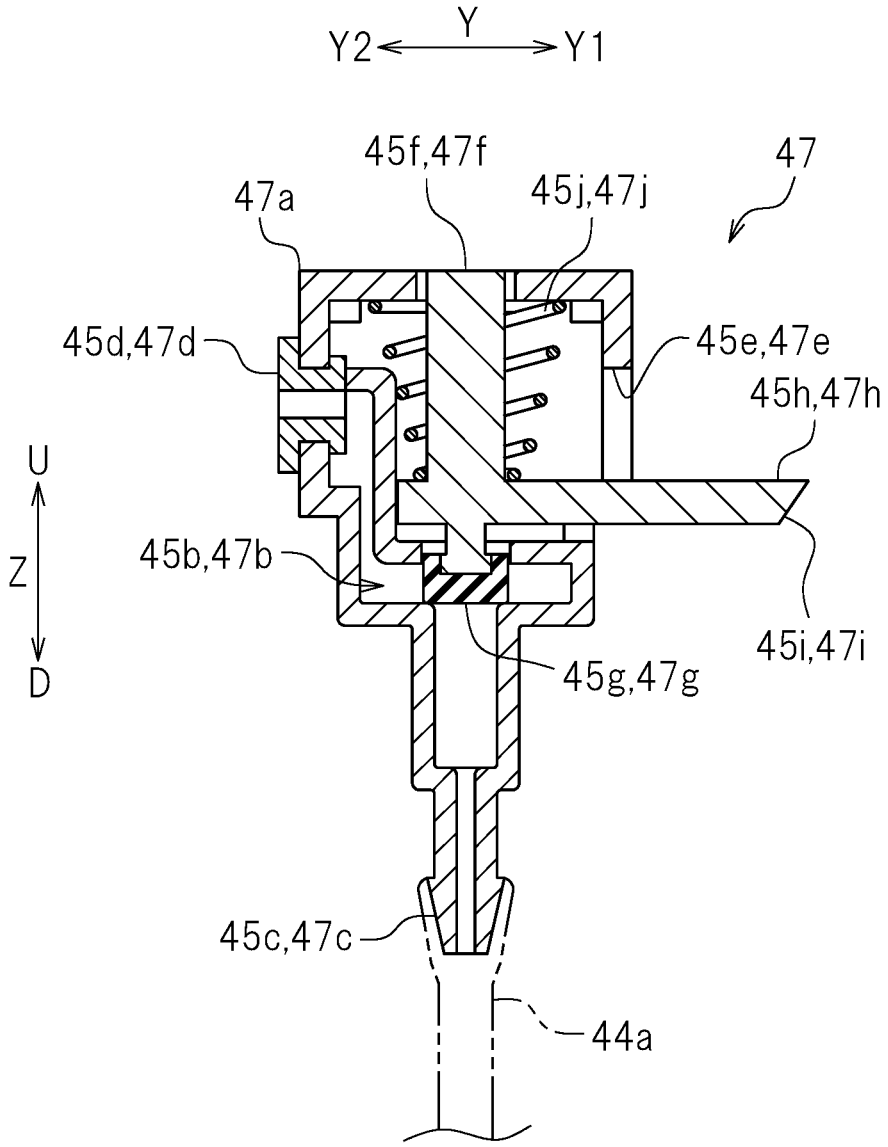
FIG. 7B is a cross-sectional view of the cap valve according to a preferred embodiment of the present invention, illustrating the closed state of the cap valve.

FIG. 6 is a front view of the composite cap valve 47. FIGS. 7A and 7B are cross-sectional views of the composite cap valve 47. Each composite cap valve 47 includes a composite valve case 47*a*. Components of two cap valves 45 are held in the composite valve case 47*a* of each composite cap valve 47. Each composite cap valve 47 includes the composite valve case 47*a*, a piston valve element 45*f* (which may hereinafter be referred to as a "first piston valve element 45*f*"), a piston valve element 47*f* (which may hereinafter be referred to as a "second piston valve element 47*f*"), a spring 45*j*, and a spring 47*j*. The composite valve case 47*a* includes an inlet 45*c* (which may hereinafter be referred to as a "first inlet 45*c*"), an inlet 47*c* (which may hereinafter be referred to as a "second inlet 47*c*"), an outlet 45*d*, an outlet 47*d*, an opening 45*e*, and an opening 47*e*. The composite valve case 47*a* internally includes: an inner passage 45*b* through which the inlet 45*c* and the outlet 45*d* are in communication with each other; and an inner passage 47*b* through which the inlet 47*c* and the outlet 47*d* are in communication with each other. The inner passage 45*b* may hereinafter be referred to as a "first inner passage 45*b*". The inner passage 47*b* may hereinafter be referred to as a "second inner passage 47*b*". The inlets 45*c* and 47*c* are each protruded in the downward direction D from the lower surface of the composite valve case 47*a*. The outlets 45*d* and 47*d* are each protruded rearward from the back surface of the composite valve case 47*a*. The openings 45*e* and 47*e* are disposed in the front face of the composite valve case 47*a*. The openings 45*e* and 47*e* are each elongated in the up-down direction Z.

A large portion of each of the piston valve elements 45*f* and 47*f* is held in the composite valve case 47*a*. The piston valve elements 45*f* and 47*f* are movable in the up-down direction Z inside the composite valve case 47*a*. When the piston valve elements 45*f* and 47*f* are located at closing positions (i.e., lowermost positions), the piston valve elements 45*f* and 47*f* respectively close the inner passages 45*b* and 47*b* (see FIG. 7B). With the piston valve elements 45*f* and 47*f* located at the closing positions, the lower ends of the piston valve elements 45*f* and 47*f* respectively intersect and block at least portions of the inner passages 45*b* and 47*b*. The lower end of the piston valve element 45*f* is provided with a gasket 45*g* to tightly seal the inner passage 45*b*, with the piston valve element 45*f* located at the closing position.

The lower end of the piston valve element 47*f* is provided with a gasket 47*g* to tightly seal the inner passage 47*b*, with the piston valve element 47*f* located at the closing position. When the piston valve elements 45*f* and 47*f* are located on the upper side U relative to the closing positions, the piston valve elements 45*f* and 47*f* respectively open the inner passages 45*b* and 47*b* (see FIG. 7A). With the piston valve elements 45*f* and 47*f* located on the upper side U relative to the closing positions, the upper ends of the piston valve elements 45*f* and 47*f* protrude out of the composite valve case 47*a*. The springs 45*j* and 47*j* are held in the composite valve case 47*a*. Each of the springs 45*j* and 47*j* is a compression coil spring including one end secured to an inner wall of the composite valve case 47*a*. The piston valve elements 45*f* and 47*f* are respectively disposed inside the coils of the springs 45*j* and 47*j*. The piston valve element 45*f* is urged by gravity and the spring 45*j* such that the piston valve element 45*f* is located at the closing position under normal conditions. The piston valve element 47*f* is urged by gravity and the spring 47*j* such that the piston valve element 47*f* is located at the closing position under normal conditions. The spring 45*j* urges the piston valve element 45*f* to the closing position and guides movement of the piston valve element 45*f* in the up-down direction Z. The spring 47*j* urges the piston valve element 47*f* to the closing position and guides movement of the piston valve element 47*f* in the up-down direction Z.

The piston valve element 45*f* includes a rod 45*h* (which may hereinafter be referred to as a "first rod 45*h*") protruding in the main scanning direction Y. The piston valve element 47*f* includes a rod 47*h* (which may hereinafter be referred to as a "second rod 47*h*") protruding in the main scanning direction Y. A first end of the rod 45*h* is secured to the piston valve element 45*f*. A first end of the rod 47*h* is secured to the piston valve element 47*f*. The rod 45*h* is secured to the lower portion of the piston valve element 45*f*. The rod 47*h* is secured to the lower portion of the piston valve element 47*f*. A second end of the rod 45*h* extends out of the composite valve case 47*a* through the opening 45*e*. A second end of the rod 47*h* extends out of the composite valve case 47*a* through the opening 47*e*. The second end of the rod 45*h* includes an inclined surface 45*i* extending obliquely upward to the right such that the second end of the rod 45*h* tapers to its upper tip. The second end of the rod 47*h* includes an inclined surface 47*i* extending obliquely upward to the right such that the second end of the rod 47*h* tapers to its upper tip. At normal times, the piston valve element 45*f* is urged to the closing position by the spring 45*j*, so that the rod 45*h* of the piston valve element 45*f* passes through a lower region of the opening 45*e*. At normal times, the piston valve element 47*f* is urged to the closing position by the spring 47*j*, so that the rod 47*h* of the piston valve element 47*f* passes through a lower region of the opening 47*e*. Lifting the rod 45*h* in the upward direction U moves the rod 45*h* in the upward direction U through the opening 45*e*. Lifting the rod 47*h* in the upward direction U moves the rod 47*h* in the upward direction U through the opening 47*e*. In accordance with the movement of the rod 45*h* in the upward direction U, the piston valve element 45*f* moves in the upward direction U against the elastic force of the spring 45*j*. In accordance with the movement of the rod 47*h* in the upward direction U, the piston valve element 47*f* moves in the upward direction U against the elastic force of the spring 47*j*. The movement of the piston valve elements 45*f* and 47*f* in the upward direction U opens the composite cap valve 47. The rods 45*h* and 47*h* are liftable independently or in conjunction with each other. Thus, the two cap valves 45 of each composite cap valve 47 are openable and closable independently or in conjunction with each other.

The composite valve case 47*a* may be divided into: a first cap valve area A including the inner passage 45*b*, the piston valve element 45*f*, the rod 45*h*, and the spring 45*j*; and a second cap valve area B including the inner passage 47*b*, the piston valve element 47*f*, the rod 47*h*, and the spring 47*j*. The first cap valve area A defines and functions as one of the two cap valves 45 of the composite cap valve 47. The second cap valve area B defines and functions as the other one of the two cap valves 45 of the composite cap valve 47. The composite valve case 47*a* includes a through hole 47*k* between the first cap valve area A and the second cap valve area B. The through hole 47*k* passes through the composite valve case 47*a* in the up-down direction Z.

Figure 8:
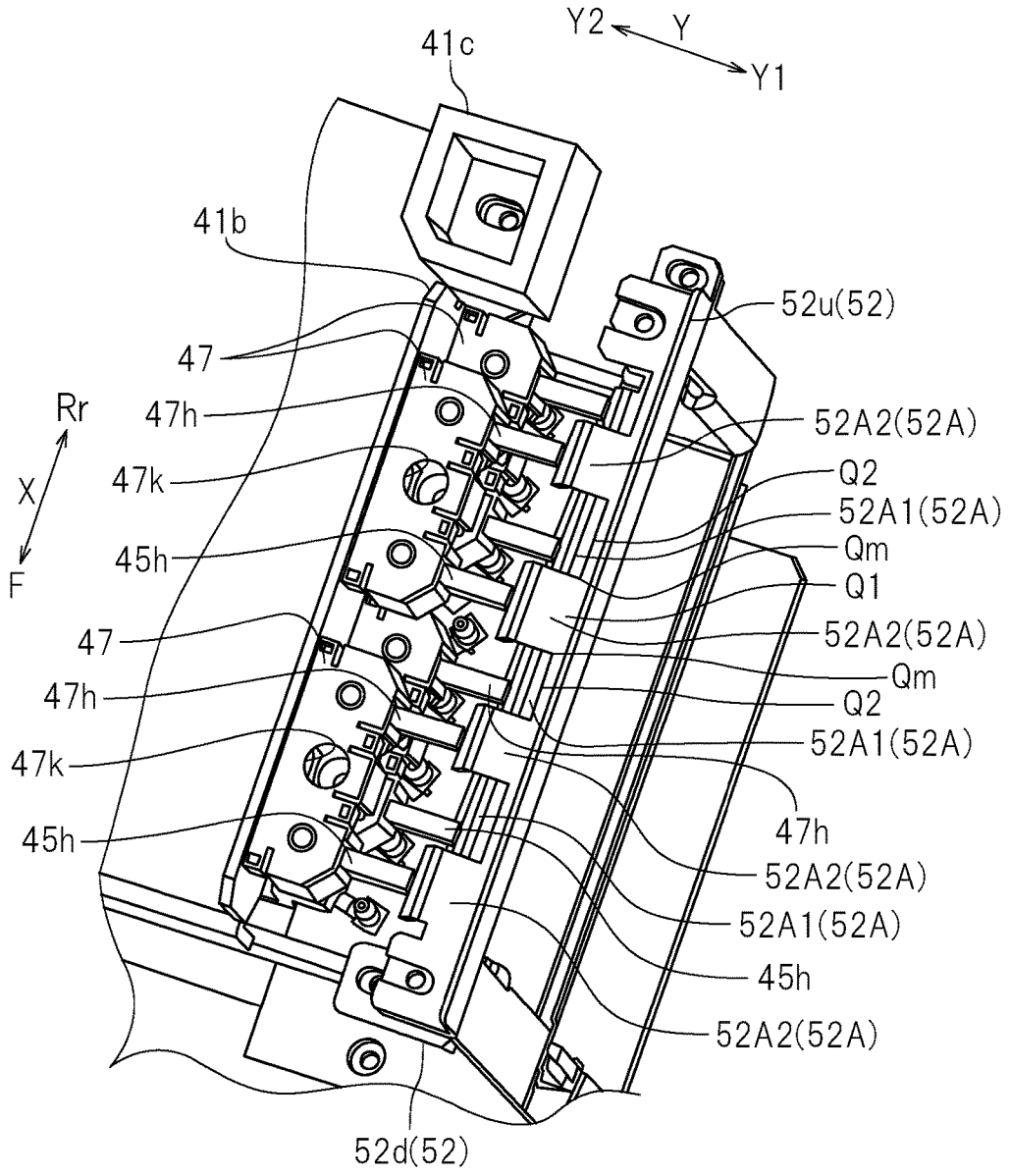
FIG. 8 is a perspective view of lifters of a conveyor according to a preferred embodiment of the present invention, illustrating the structure of each lifter.

As illustrated in FIG. 4, the four composite cap valves 47 are disposed on the right surface of the table wall 41*b* (i.e., a surface of the table wall 41*b* facing in the first direction Y1). Each cap valve 45 is disposed such that the front of each cap valve 45 faces in the first direction Y1. The rods 45*h* and 47*h* are disposed such that the rods 45*h* and 47*h* protrude in the first direction Y1 of the main scanning direction Y. The table wall 41*b* is provided with through holes at locations where the cap valves 45 are to be attached to the table wall 41*b*. The outlets 45*d* and 47*d* of the cap valves 45 are inserted into the through holes of the table wall 41*b* (see FIGS. 9A to 9C). As illustrated in FIG. 8, two of the four composite cap valves 47 are disposed on a relatively upper portion of the table wall 41*b* and in alignment with each other in the front-rear direction X. The other two of the four composite cap valves 47 are disposed on a relatively lower portion of the table wall 41*b* and in alignment with each other in the front-rear direction X. The two composite cap valves 47 on the upper side U are deviated from the other two composite cap valves 47 on the lower side D in the front-rear direction X by one-half of the dimension of the first cap valve area A or the second cap valve area B in the front-rear direction X. Thus, the inlets 45*c* and 47*c* of the two composite cap valves 47 on the upper side U are inserted into the through holes 47*k* of the two composite cap valves 47 on the lower side D. Although not illustrated in detail, the opening passages 44*a* connected to the inlets 45*c* and 47*c* of the two composite cap valves 47 on the upper side U are also inserted into the through holes 47*k* of the two composite cap valves 47 on the lower side D. The dimension of each of the inlets 45*c* and 47*c* in the plan view (e.g., the outer diameter of each of the inlets 45*c* and 47*c*) is smaller than the dimension of each through hole 47*k* in the plan view (e.g., the inner diameter of each through hole 47*k*). The dimension of each through hole 47*k* in the plan view is larger than the dimension of each of the inlets 45*c* and 47*c* in the plan view. Thus, the four composite cap valves 47 are arranged in a "hound's tooth pattern". As used herein, the term "hound's tooth pattern" refers to a pattern in which the composite cap valves 47 are disposed in a staggered configuration. Accordingly, the term "hound's tooth pattern" may refer to a gingham check pattern, a zigzag arrangement, a staggered arrangement, and other similar arrangements and patterns.

Each opening passage 44*a* connected to the associated cap 42 extends in the rightward direction R (i.e., the first direction Y1) from a location below the movable table 41. The opening passages 44*a* extending from an associated pair of the caps are connected to the inlets 45*c* and 47*c* of the associated composite cap valve 47. As illustrated in FIGS. 7A and 7B, the inlets 45*c* and 47*c* disposed on the lower ends of the cap valves 45 define and function as downstream connections connected to the associated opening passages 44*a*. The inlets 45*c* and 47*c* of each composite cap valve 47 are connected, through the associated opening passages 44*a*, for example, to an associated pair of the caps 42 adjacent to each other.

Each suction pump 46 includes an inlet on the upstream side, and an outlet on the downstream side. Each suction pump 46 sucks, through the inlet, a fluid (e.g., gas such as air or liquid such as ink) in a portion of the associated suction passage 44*b* connected to the upstream inlet of the suction pump 46, and sends the fluid to the outlet. This reduces the pressure inside the portion of the associated suction passage 44*b* connected to the upstream inlet of the suction pump 46. Thus, with each cap 42 attached to the associated ink head 32, driving each suction pump 46 reduces the pressure inside the associated enclosed space S and sucks the fluid inside the associated enclosed space S. Each suction pump 46 sends the sucked fluid to a downstream portion of the associated suction passage 44*b*. Each suction pump 46 is not limited to any particular configuration. In one example, each suction pump 46 is a cylinder type suction pump. Each suction pump 46 is an example of a suction device. The waste liquid bottle 49 is a container to contain liquid (such as ink) discharged to the downstream side from each suction pump 46. The waste liquid bottle 49 may be attachable to and detachable from the lower portion of the side cover 15, for example.

As illustrated in FIG. 2, the conveyor 50 moves the movable table 41. The conveyor 50 includes a base 51, a right side wall 52, a guide wall 53, and a spring 55.

The base 51 defines and functions as a base for an entirety of the conveyor 50. The right side wall 52 stands vertically or substantially vertically in the up-down direction Z on an end of the base 51 facing in the first direction Y1. The upper end of the right side wall 52 includes lifters 52A each extending obliquely downward to the left. In other words, each lifter 52A includes an inclined surface extending obliquely upward to the right. Each lifter 52A is a member to lift the rod 45*h* or 47*h* of the associated cap valve 45. Each lifter 52A is provided by sheet metal processing. In one example, each lifter 52A is provided by bending the upper end of the right side wall 52.

In the present preferred embodiment, each lifter 52A is disposed on a portion of the right side wall 52 that faces the rod 45*h* or 47*h* in the second direction Y2. Because the four composite cap valves 47 are disposed in a hound's tooth pattern, the rods 45*h* and 47*h* are also disposed in a hound's tooth pattern. Thus, the lifters 52A according to the present preferred embodiment are also disposed in a hound's tooth pattern. Specifically, the right side wall 52 includes a first right side wall 52*d* and a second right side wall 52*u*. With the composite cap valves 47 in the closed state, the first right side wall 52*d* is located below the rods 45*h* and 47*h* of the two composite cap valves 47 disposed on the relatively lower portion of the table wall 41*b*. With the composite cap valves 47 in the closed state, the second right side wall 52*u* is located above the rods 45*h* and 47*h* of the two composite cap valves 47 disposed on the relatively lower portion of the table wall 41*b*.

The first right side wall 52*d* is made of a sheet of steel connected to the base 51. The lifters 52A include first lifters 52A1. The first lifters 52A1 are provided on the upper end of the first right side wall 52*d* by sheet metal processing. Specifically, the first lifters 52A1 are provided by bending the upper end of the first right side wall 52*d* such that the first lifters 52A1 extend toward the composite cap valves 47 (i.e., substantially in the second direction Y2). Each first lifter 52A1 is provided on a portion of the first right side wall 52*d* that faces the rod 45*h* or 47*h*, but no lifter 52A1 is provided on a portion of the first right side wall 52*d* that does not face the rod 45*h* or 47*h*. Whether a portion of the first right side wall 52*d* faces the rod 45*h* or 47*h* does not necessarily have to be determined based on whether the portion of the first right side wall 52*d* faces the rod 45*h* or 47*h* in the main scanning direction Y in a strict sense. For example, suppose that distances are measured between each rod 45*h* or 47*h* and points on an imaginary line extending in the front-rear direction X on the first right side wall 52*d* (which may be the second side wall 52*u*) at a height at which the first right side wall 52*d* faces the rods 45*h* and 47*h*. In this case, the present preferred embodiment involves defining, in accordance with the distances measured, first points Q1 each located closest to the associated rod 45*h* or 47*h* and second points Q2 each located farthest away from the associated rod 45*h* or 47*h*. An intermediate point Qm is located between each first point Q1 and the associated second point Q2, for example in the center. Thus, a portion of the first right side wall 52*d* located closer to the first point Q1 relative to the intermediate point Qm may be determined as a "portion of the first right side wall 52*d* that faces the rod 45*h* or 47*h*", and a portion of the first right side wall 52*d* located closer to the second point Q2 relative to the intermediate point Qm may be determined as a "portion of the first right side wall 52*d* that does not face the rod 45*h* or 47*h*". Accordingly, the first right side wall 52*d* has a saw-toothed shape having projections and recesses arranged alternately in the plan view, with the first lifters 52A1 defining the projections.

The second right side wall 52*u* made of a sheet of steel is connected to the upper portion of the first right side wall 52*d*. A portion of the first right side wall 52*d* and a portion of the second right side wall 52*u* are flush or substantially flush with each other in the up-down direction Z. The lifters 52A include second lifters 52A2. The second lifters 52A2 are provided on the upper end of the second right side wall 52*u* by sheet metal processing. Specifically, the second lifters 52A2 are provided by bending the upper end of the second right side wall 52*u* such that the second lifters 52A2 extend toward the composite cap valves 47 (i.e., substantially in the second direction Y2). Each second lifter 52A2 is provided on a portion of the second right side wall 52*u* that faces the rod 45*h* or 47*h*, but no second lifter 52A2 is provided on a portion of the second right side wall 52*u* that does not face the rod 45*h* or 47*h*. A portion of the second right side wall 52*u* that faces the rod 45*h* or 47*h* and a portion of the second right side wall 52*u* that does not face the rod 45*h* or 47*h* may be determined in a manner similar to that used for the first right side wall 52*d*. Accordingly, the second right side wall 52*u* has a saw-toothed shape having projections and recesses arranged alternately in the plan view, with the second lifters 52A2 defining the projections.

As previously described, the rods 45*h* and 47*h* are arranged in a hound's tooth pattern. Thus, the first and second lifters 52A1 and 52A2 are also arranged in a hound's tooth pattern. In one example, the first and second lifters 52A1 and 52A2 are arranged such that each first lifter 52A1 is located between the second lifters 52A2 in the plan view. In the plan view, the rods 45*h* and 47*h* of the two composite cap valves 47 disposed on the relatively lower portion of the table wall 41*b* are each located between the second lifters 52A2 protruding from the right side wall 52.

Figure 9A:
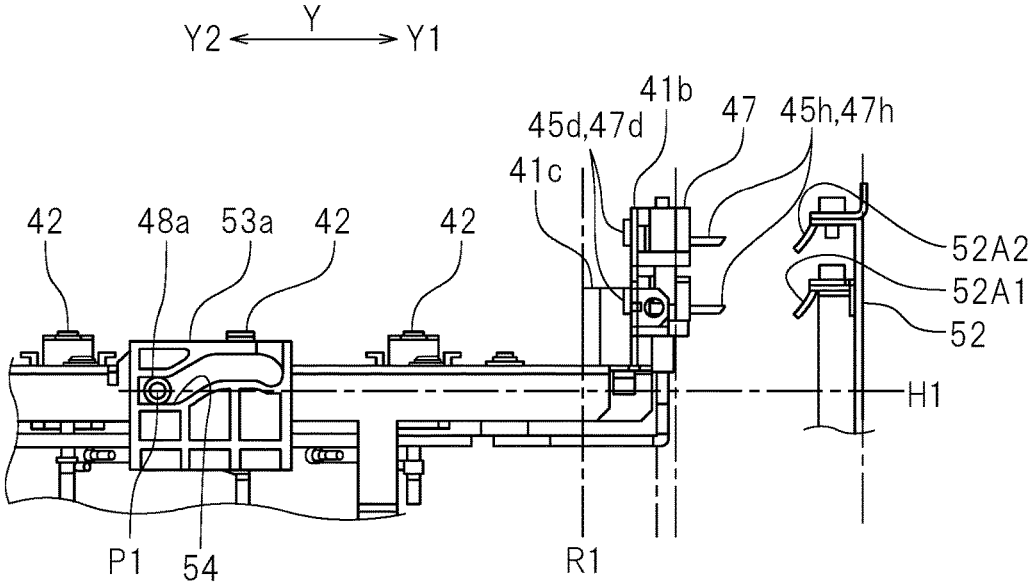
FIG. 9A is a front view of main components of the cap unit located at a standby position.
Figure 9B:
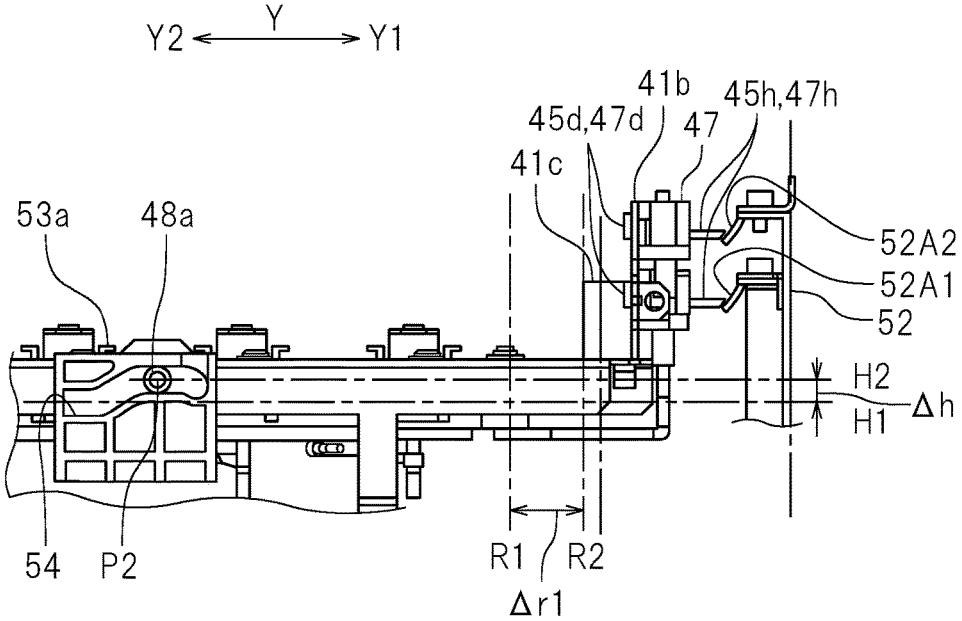
FIG. 9B is a front view of the main components of the cap unit located at a cap attaching position.
Figure 9C:
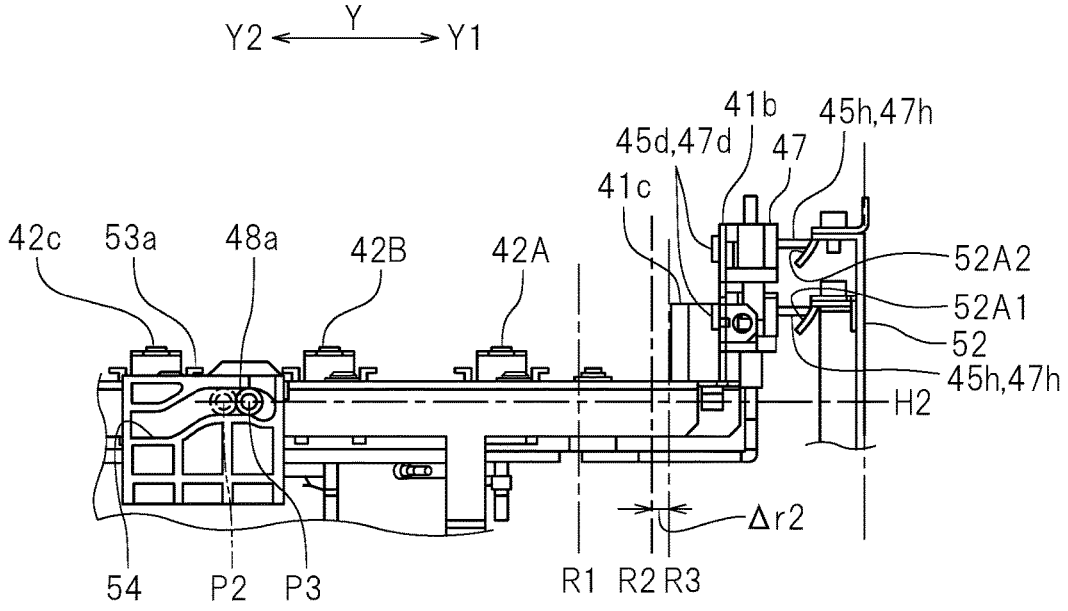
FIG. 9C is a front view of the main components of the cap unit located at a valve opening position.

The guide wall 53 stands vertically or substantially vertically on the base 51 and extends in the main scanning direction Y. The guide wall 53 includes: a guide wall 53*a* disposed on the front portion of the base 51; a guide wall 53*b* disposed on the front portion of the base 51; a guide wall 53*c* disposed on the rear portion of the base 51; and a guide wall 53*d* disposed on the rear portion of the base 51. The guide walls 53*a* and 53*c* face each other in the front-rear direction X on the base 51. The guide walls 53*b* and 53*d* face each other in the front-rear direction X on the base 51. The four guide walls 53*a*, 53*b*, 53*c*, and 53*d* are identical or substantially identical in shape. The four guide walls 53*a*, 53*b*, 53*c*, and 53*d* are provided with guide holes 54. As illustrated in FIGS. 9A to 9C, each guide hole 54 is an elongated hole that extends obliquely upward from a lower left position P1 to an upper right position P2 and then extends in the rightward direction R from the position P2 to a position P3. The position P1 is located at a height H1. The positions P2 and P3 are each located at a height H2. The height H2 is higher than the height H1 by a distance Δh. The positions P1 and P2 have a distance Δr1 therebetween in the right-left direction Y. The positions P2 and P3 have a distance Δr2 therebetween in the right-left direction Y. The guide pins 48*a*, 48*b*, 48*c*, and 48*d* of the movable table 41 of the cap unit 40 are respectively inserted into the guide holes 54 of the guide walls 53*a*, 53*b*, 53*c*, and 53*d*. Thus, the movable table 41 is supported by the guide wall 53. The guide holes 54 define a path along which the movable table 41 is movable.

The spring 55 is connected to the upper surface of the base 51 and the lower surface of the movable table 41. The connection between the spring 55 and the movable table 41 is located obliquely above and rightward of the connection between the spring 55 and the base 51. In one example, a helical tension spring is usable as the spring 55. The spring 55 is connected, under predetermined tension, to the base 51 and the movable table 41. The spring 55 urges the movable table 41 downward to the left at all times.

The conveyor 50 moves the movable table 41 in conjunction with movement of the ink head unit 30. In other words, the conveyor 50 moves the cap unit 40 in conjunction with movement of the ink heads 32. The conveyor 50 is an example of a cap conveyor to move the cap unit 40 between a cap attaching position and a retracted position.

As illustrated in FIG. 9A, the movable table 41 is supported by the conveyor 50 such that the guide pins 48*a*, 48*b*, 48*c*, and 48*d* are each located at the position P1 at normal times owing to the tension of the spring 55. In this state, the cap unit 40 is located at the "retracted position". In one example, the cap unit 40 is located at the retracted position during printing effected by the printer 1. With the cap unit 40 located at the retracted position, the upper ends of the caps 42 are located below the lower ends of the ink heads 32, and the left lateral surface of the movement stopper 41*c* of the movable table 41 is located at a first location R1.

Once the printer 1 has stopped printing, the ink head unit 30 is held in the side cover 15. After printing, the ink head unit 30 placed on the carriage 31 is moved along the guide rail 10 to the "cap attaching position" defined in the side cover 15. In the course of this movement, the engagement portion 31A (see FIG. 2) of the carriage 31 abuts against the movement stopper 41*c* of the movable table 41 at the retracted position so as to press the movement stopper 41*c* rightward. This moves the movable table 41 in the first direction Y1 (i.e., the rightward direction R) against the tension of the spring 55. As illustrated in FIG. 9B, the engagement portion 31A of the carriage 31 moves the movement stopper 41*c* of the movable table 41 in the first direction Y1 by the distance Δr1. As a result of this movement, the left lateral surface of the movement stopper 41*c* of the movable table 41 is located at a second location R2. The movement of the movable table 41 in the first direction Y1 is restricted by the guide holes 54. The movement of the movable table 41 in the first direction Y1 by the distance Δr1 causes each of the guide pins 48*a*, 48*b*, 48*c*, and 48*d* to move from the position P1 and the position P2. In accordance with the movement of the movable table in the first direction Y1 by the distance Δr1, the movable table 41 moves in the upward direction U by the distance Δh. The movement of the movable table 41 just described causes the caps 42 secured to the movable table 41 to be attached to the ink heads 32. In other words, moving the carriage 31 to the "cap attaching position" causes the cap unit 40 to attach the caps 42 to the ink heads 32.

As illustrated in FIG. 9C, the carriage 31 is allowed to move to a "valve opening position" located in the first direction Y1 relative to the "cap attaching position". The "valve opening position" is located in the first direction Y1 relative to the "cap attaching position" by the distance Δr2. During movement of the carriage 31 from the "cap attaching position" to the "valve opening position", the engagement portion 31A of the carriage 31 presses the movement stopper 41*c* of the movable table 41 at the cap attaching position further rightward. This moves the movable table 41 in the first direction Y1 by the distance Δr2 against the tension of the spring 55. The guide pins 48*a*, 48*b*, 48*c*, and 48*d* each move from the position P2 to the position P3. Because the position P2 and the position P3 are located at the same height, the ink heads 32 and the caps 42 move in the first direction Y1, with each cap 42 kept attached to the associated ink head 32. As a result of the movement of the carriage 31 to the "valve opening position", the left lateral surface of the movement stopper 41*c* of the movable table 41 is located at a third location R3. The movement of the carriage 31 to the "valve opening position" just described first causes the rods 45*h* and 47*h* of the composite cap valves 47, disposed on the right surface of the table wall 41*b* of the movable table 41, to abut against the lifters 52A of the right side wall 52 of the conveyor 50. More specifically, the rods 45*h* and 47*h* of the two composite cap valves 47, disposed on the relatively lower portion of the table wall 41*b*, abut against the first lifters 52A1, and the rods 45*h* and 47*h* of the two composite cap valves 47, disposed on the relatively upper portion of the table wall 41*b*, abut against the second lifters 52A2. An end of each of the rods 45*h* and 47*h* facing in the first direction Y1 includes an oblique surface extending obliquely upward to the right. An end of each of the first and second lifters 52A1 and 52A2 facing in the second direction Y2 includes an oblique surface extending obliquely upward to the right. Thus, the rods 45*h* and 47*h* and the first and second lifters 52A1 and 52A2 define a slider through which the rods 45*h* and 47*h* abut against the first and second lifters 52A1 and 52A2 so as to convert movement of the rods 45*h* and 47*h* in the right-left direction Y into movement of the rods 45*h* and 47*h* in the up-down direction Z. Accordingly, further movement of the movable table 41 in the first direction Y1 causes the rods 45*h* and 47*h* to move upward along the inclined surfaces of the first and second lifters 52A1 and 52A2, so that the rods 45*h* and 47*h* are lifted in the upward direction U. As a result, the two cap valves 45 included in each composite cap valve 47 are switched from the closed state to the open state. In other words, the movement of the carriage 31 to the "valve opening position" enables the cap valves 45 to switch to the open state, with the caps 42 attached to the ink heads 32. The rods 45*h* and 47*h* included in the four composite cap valves 47 simultaneously abut against the first and second lifters 52A1 and 52A2, so that all of the rods 45*h* and 47*h* are simultaneously lifted in the upward direction U. Consequently, the eight cap valves 45 are simultaneously switched to the open state.

Movement of the carriage 31 in the second direction Y2 toward a position leftward of the "valve opening position" or the "cap attaching position" causes the engagement portion 31A of the carriage 31 to stop applying a pressing force to the movement stopper 41*c* of the movable table 41 or reduce the pressing force applied to the movement stopper 41*c*. The movable table 41 is urged downward to the left by the spring 55. Thus, the movable table 41 is moved to the "retracted position" from the "valve opening position" or the "cap attaching position".

The controller 100 is configured or programmed to comprehensively control operations of the components of the printer 1. The controller 100 is not limited to any particular configuration. In one example, the controller 100 is a microcomputer. The microcomputer is not limited to any particular hardware configuration. In one example, the microcomputer includes: an interface (I/F) to transmit and receive information, such as print data, to and from an external device, such as a host computer; a central processing unit (CPU) to execute commands included in a printing control program; a read-only memory (ROM) storing programs to be executed by the CPU; a random-access memory (RAM) to be used as a working area where the programs are to be expanded; and a memory storing various data, such as the printing control program. The controller 100 may include a rewritable programmable logic device, such as a field-programmable gate array (FPGA). In one example, the FPGA may include a CPU core provided by an integrated circuit, a multiplier, a RAM, and related peripheral circuitry.

Figure 10:
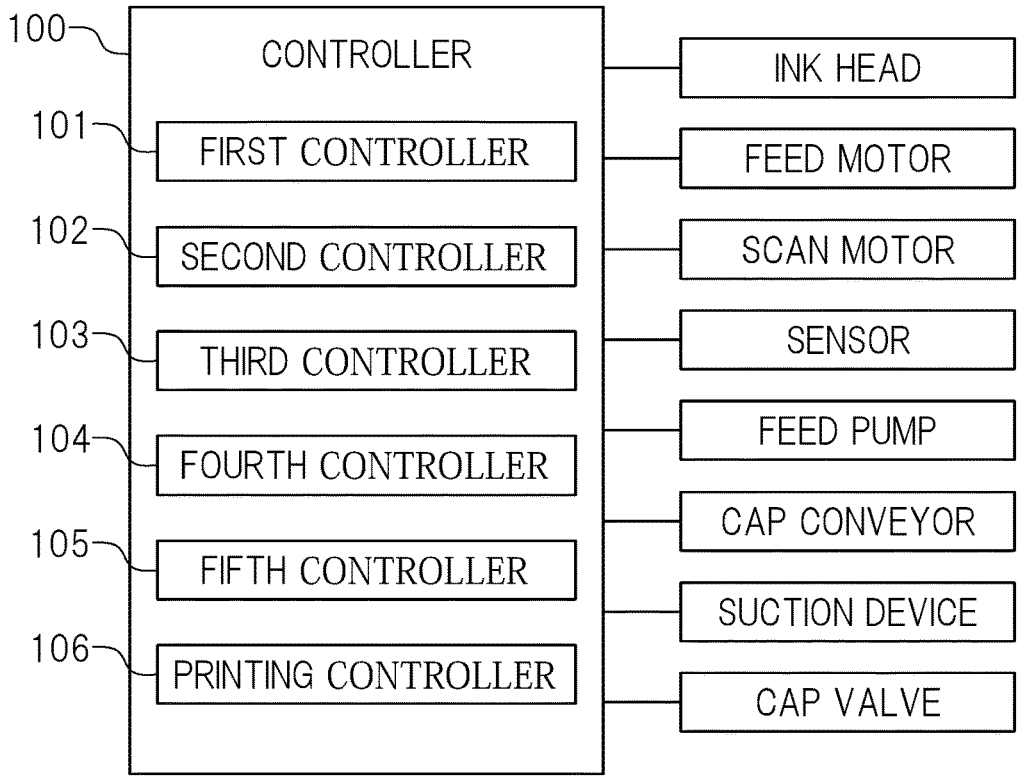
FIG. 10 is a block diagram illustrating the configuration of a controller according to a preferred embodiment of the present invention.

FIG. 10 is a block diagram of the controller 100. The controller 100 according to the present preferred embodiment is configured or programmed to include a first controller 101, a second controller 102, a third controller 103, a fourth controller 104, a fifth controller 105, and a printing controller 106. The first to fifth controllers 101 to 105 control suction cleaning for the ink heads 32, which is to be performed by the cap unit 40. The first to fifth controllers 101 to 105 cause the printer 1 to perform suction cleaning for the ink heads 32 by following the procedure illustrated in FIG. 11, for example. The printing controller 106 controls basic printing operations to be performed by the printer 1. The functions of each of the controllers of the controller 100 may be implemented by hardware (e.g., a circuit and/or a microprocessor) or may be implemented by executing a computer program by the CPU.

The printing controller 106 is electrically connected to the ink heads 32, the feed motor, and the scan motor. In accordance with the printing control program and the print data stored in the memory, the printing controller 106 causes the scan motor to move the carriage 31 in the main scanning direction Y at a predetermined speed. The printing controller 106 then causes the ink heads 32 mounted on the carriage 31 to discharge ink from predetermined positions based on the print data. This operation and movement of the recording medium 8 in the sub-scanning direction X caused by the feed motor are repeatedly carried out in an alternating manner. Thus, the printer 1 effects printing in accordance with the print data.

Figure 11:
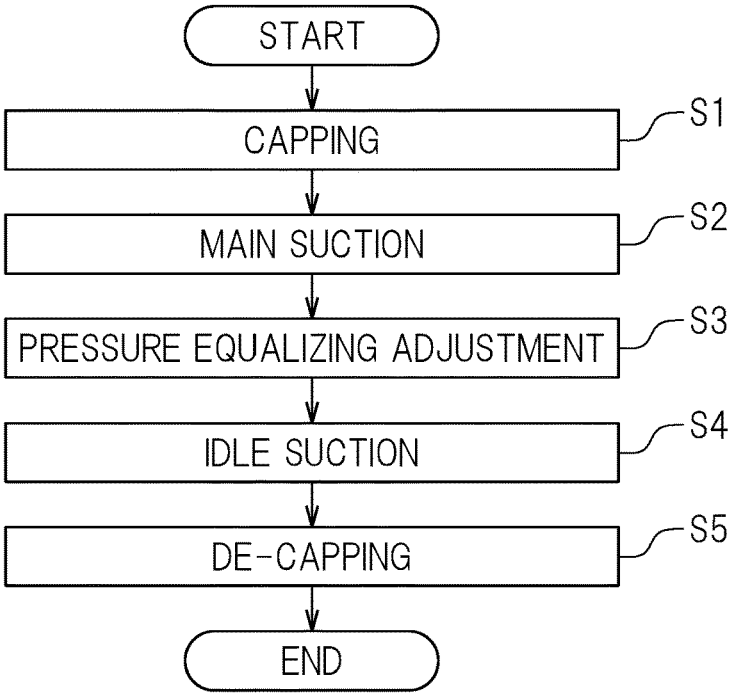
FIG. 11 is a flow chart illustrating the procedure of suction cleaning according to a preferred embodiment of the present invention.

The first controller 101 performs capping (S1 in FIG. 11). The first controller 101 is electrically connected to the scan motor to move the ink heads 32. Suction cleaning for the ink heads 32, which is to be performed by the printer 1, first involves actuating the scan motor by the first controller 101 so as to move the carriage 31 to the cap attaching position. Thus, the carriage 31 causes the cap unit 40 located at a standby position to move to the cap attaching position. As a result, the caps 42 are attached to the ink heads 32. The enclosed space S is defined between each cap 42 and the associated ink head 32.

The second controller 102 performs main suction (S2 in FIG. 11). The second controller 102 is electrically connected to the suction pumps 46. After the caps 42 are attached to the ink heads 32 by the first controller 101, the second controller 102 drives the suction pumps 46. This reduces the pressure inside each enclosed space S. In one example, the second controller 102 reduces the pressure inside each enclosed space S such that the pressure inside each enclosed space S is in the range of about −20 kPa to about −35 kPa. The second controller 102 may reduce the pressure inside each enclosed space S to about −30 kPa, for example. In one example, the second controller 102 drives the suction pumps 46 at a flow velocity between about 3 cc/sec and about 10 cc/sec inclusive. The second controller 102 may drive the suction pumps 46 at a flow velocity of about 7.3 cc/sec, for example. The flow velocity may vary depending on the capacity of each cap 42. In one example, the time required for such pressure reduction is about 10 seconds to about 20 seconds. The time required for such pressure reduction may be about 13.7 seconds, for example. Thus, ink remaining in the nozzles of the ink heads 32 is dischargeable to the caps 42 and the passages 44. The ink discharged to the caps 42 and the passages 44 from the ink heads 32 is collectable into the waste liquid bottle 49.

The third controller 103 makes a pressure equalizing adjustment (S3 in FIG. 11). The third controller 103 is electrically connected to the suction pumps 46. The third controller 103 deactivates the suction pumps 46 activated by the second controller 102 and maintains the deactivated state of the suction pumps 46. Deactivating the suction pumps 46 by the third controller 103 ends main suction in suction cleaning. The third controller 103 subsequently maintains the deactivated state of the suction pumps 46, with the caps 42 attached to the ink heads 32. In one example, the depressurized state is maintained by the third controller 103 for about 3 seconds to about 10 seconds. The depressurized state may be maintained by the third controller 103 for about 5 seconds, for example. Thus, the depressurized state of the enclosed spaces S and the nozzles of the ink heads 32 is maintained such that the pressures inside the enclosed spaces S and the nozzles of the ink heads 32 are equalized.

The fourth controller 104 performs idle suction (S4 in FIG. 11). The fourth controller 104 switches the composite cap valves 47 to the open state and drives the suction pumps 46, with the caps 42 attached to the ink heads 32. The fourth controller 104 is electrically connected to the scan motor and the suction pumps 46. The fourth controller 104 activates the scan motor so as to move the carriage 31 to the valve opening position. Thus, the cap unit 40 and the ink head unit 30, located at the cap attaching position, are moved to the valve opening position, with the caps 42 kept attached to the ink heads 32. As a result, the rods 45*h* and 47*h* of the composite cap valves 47 abut against the first and second lifters 52A1 and 52A2, so that the rods 45*h* and 47*h* are lifted in the upward direction U and the composite cap valves 47 are switched to the open state. The movement of the carriage 31 to the valve opening position simultaneously switches all of the composite cap valves 47 to the open state. Driving the suction pumps 46 by the fourth controller 104 reduces the pressure of a portion of each suction passage 44*b* upstream of the associated suction pump 46. In one example, the fourth controller 104 causes each suction pump 46 to suck the fluid in a portion of the associated suction passage 44*b* upstream of the suction pump 46 and discharge the fluid to a portion of the suction passage 44*b* downstream of the suction pump 46 (or external atmosphere) at a transfer rate higher than that for main suction. The transfer rate may vary depending on the capacity of each cap 42. In one example, the fourth controller 104 drives the suction pumps 46 at a flow velocity between about 40 cc/sec and about 80 cc/sec inclusive. The fourth controller 104 may drive the suction pumps 46 at a flow velocity of about 65.6 cc/sec, for example. In one example, the time required for such pressure reduction is about 1 second to about 10 seconds. The time required for such pressure reduction may be about 5 seconds, for example. The fourth controller 104 may simultaneously carry out the movement of the carriage 31 effected by the scan motor and the suction effected by the suction pumps 46 or may drive the suction pumps 46 after moving the carriage 31 to the valve opening position. Thus, ink remaining in the opening passages 44*a*, the enclosed spaces S, the caps 42, and portions of the suction passages 44*b*, which are upstream of the suction pumps 46, is discharged downstream of the suction pumps 46. The ink discharged is collectable into the waste liquid bottle 49.

The fifth controller 105 performs de-capping (S5 in FIG. 11). The fifth controller 105 deactivates the suction pumps 46, brings the composite cap valves 47 to the closed state, and moves the cap unit 40 to the retracted position. The fifth controller 105 is electrically connected to the suction pumps 46 and the scan motor. The fifth controller 105 deactivates the suction pumps 46 so as to end idle suction in suction cleaning. The time required for idle suction is about 1 second to about 10 seconds, for example, as previously mentioned. The fifth controller 105 activates the scan motor so as to move the carriage 31 to a position leftward of the cap attaching position. The position leftward of the cap attaching position may be a home position. Thus, the rods 45*h* and 47*h* of the composite cap valves 47 move away from the first and second lifters 52A1 and 52A2 of the conveyor 50 in the leftward direction L, so that the rods 45*h* and 47*h* return to lower positions. In other words, the composite cap valves 47 are switched to the closed state. Because the movable table 41 is urged downward to the left by the spring 55, the cap unit 40 is moved to the retracted position. This ends suction cleaning.

In the present preferred embodiment, the cap unit 40 includes the table wall 41*b* standing vertically or substantially vertically on the end of the movable table 41 facing in the first direction Y1. The composite cap valves 47 are disposed on the table wall 41*b*. The number of composite cap valves 47 increases in accordance with an increase in the number of ink heads 32. The table wall 41*b* is disposed such that the table wall 41*b* does not interfere with movement of the ink head unit 30. The composite cap valves 47 are disposed on the table wall 41*b* such that the composite cap valves 47 are arranged not only in a horizontal or substantially horizontal direction but also in a vertical or substantially vertical direction. Accordingly, if the number of ink heads 32 is increased, disposing the composite cap valves 47 on the table wall 41*b* standing vertically or substantially vertically in the up-down direction Z would provide the cap unit 40 without excessively increasing the area where the printer 1 is to be installed. Consequently, the present preferred embodiment provides the printer 1 that is readily adaptable to an increase in the number of ink heads 32.

In the present preferred embodiment, the table wall 41*b* of the movable table 41 is provided by bending a single steel plate that defines the movable table 41. Providing the table wall 41*b* in this manner enables the table wall 41*b* to be securely disposed on the movable table 41. Providing the table wall 41*b* in this manner reduces the number of components of the cap unit 40. This is advantageous in terms of manufacturing the printer 1 and keeping the printer 1 in a good condition.

In the present preferred embodiment, the movable table 41 includes the movement stopper 41*c* protruding upward. The ink head conveyor includes: the carriage 31 supporting the ink heads 32; the carriage conveyor to move the carriage 31 in the main scanning direction Y; and the engagement portion 31A disposed on the carriage 31 to come into engagement with the movement stopper 41*c*. With the engagement portion 31A in engagement with the movement stopper 41*c*, the carriage conveyor moves the carriage 31 from the first location R1 to the second location R2 (which is located in the first direction Y1 relative to the first location R1) in the first direction Y1. This moves the movable table 41 from the retracted position to the cap attaching position. With the engagement portion 31A in engagement with the movement stopper 41*c*, the carriage conveyor moves the carriage 31 from the second location R2 to the first location R1 in the second direction Y2. This moves the movable table 41 from the cap attaching position to the retracted position. Thus, the carriage conveyor to move the carriage 31 in the main scanning direction Y enables movement of the movable table 41 between the retracted position and the cap attaching position. Consequently, the present preferred embodiment makes it possible to move the cap unit 40 without providing power to be used exclusively for the cap unit 40.

In the present preferred embodiment, the cap unit 40 includes the composite cap valves 47 each including the first cap valve 45 and the second cap valve 45 integral with each other. Each composite cap valve 47 includes the composite valve case 47*a*, the first piston valve element 45*f*, the first rod 45*h*, the spring 45*j*, the second piston valve element 47*f*, the second rod 47*h*, and the spring 47*j*. The composite valve case 47*a* includes the first inner passage 45*b* and the second inner passage 47*b*. The first piston valve element 45*f* is held in the composite valve case 47*a* to move in the up-down direction Z so as to switch the first inner passage 45*b* between the open state and the closed state. The first rod 45*h* protrudes from the first piston valve element 45*f* in the main scanning direction Y and at least partially extends out of the composite valve case 47*a*. The spring 45*j* is held in the composite valve case 47*a* and defines and functions as a first elastic member to urge the first piston valve element 45*f* upward or downward so as to close the first inner passage 45*b*. The second piston valve element 47*f* is held in the composite valve case 47*a* to move in the up-down direction Z so as to switch the second inner passage 47*b* between the open state and the closed state. The second rod 47*h* protrudes from the second piston valve element 47*f* in the main scanning direction Y and at least partially extends out of the composite valve case 47*a*. The spring 47*j* is held in the composite valve case 47*a* and defines and functions as a second elastic member to urge the second piston valve element 47*f* upward or downward so as to close the second inner passage 47*b*. Thus, the two cap valves 45 included in each composite cap valve 47 and in communication with associated two of the caps 42 to be attached to the ink heads 32 are integral with each other. Accordingly, when the ink heads 32 are arranged in pairs in the sub-scanning direction X so as to effect printing with a print span doubled for each round of scanning, two of the opening passages 44*a* are connected to an associated one of the composite cap valves 47, so that the opening passages 44*a* connect the associated pair of caps 42 to the associated pair of cap valves 45. This simplifies the arrangement of the passages. Such an arrangement makes it possible to reduce the number of components. Consequently, the present preferred embodiment provides the printer 1 that is readily adaptable to an increase in the number of ink heads 32.

In the present preferred embodiment, the composite valve case 47*a* includes the through hole 47*k* passing through the composite valve case 47*a* in the up-down direction Z. The through hole 47*k* is located between the first cap valve area A and the second cap valve area B. The first cap valve area A includes the first inner passage 45*b*, the first piston valve element 45*f*, the first rod 45*h*, and the spring 45*j* (i.e., the first elastic member). The second cap valve area B includes the second inner passage 47*b*, the second piston valve element 47*f*, the second rod 47*h*, and the spring 47*j* (i.e., the second elastic member). The composite cap valves 47 include at least first composite cap valves 47 and second composite cap valves 47. The first composite cap valves 47 are disposed on the table wall 41*b* such that the first composite cap valves 47 are located above the second composite cap valves 47 and out of alignment with the second composite cap valves 47 in a direction perpendicular to the up-down direction Z. The opening passages 44*a* (i.e., the first passages) each connected to at least one of the first inlet 45*c* and the second inlet 47*c* of the associated first composite cap valve 47 is inserted through the through hole 47*k* of the associated second composite cap valve 47. Thus, when the composite valve cases 47*a* are arranged on the table wall 41*b* in a vertical or substantially vertical direction, for example, the passages (or tubes) connected to the upper composite valve cases 47*a* are allowed to extend to a region below the movable table 41 through the through holes 47*k* of the lower composite valve cases 47*a*. This saves space occupied by the cap unit 40. The present preferred embodiment prevents the passages connected to the composite valve cases 47*a* from interfering with the opening and closing of the composite cap valves 47 during movement of the movable table 41 between the cap attaching position and the valve opening position.

In the present preferred embodiment, the base 51 of the conveyor 50 includes the right side wall 52. The right side wall 52 is a side wall standing vertically or substantially vertically on the end of the base 51 facing in the first direction Y1. The right side wall 52 includes the lifters 52A at locations where the right side wall 52 faces the first and second rods 45*h* and 47*h* of the first composite cap valve 47 and the first and second rods 45*h* and 47*h* of the second composite cap valve 47. Each lifter 52A defines and functions as a valve opening surface that extends between a height corresponding to the height of the rods 45*h* and 47*h* of the associated composite cap valve 47 including inner passages 45*b* and 47*b* that are respectively closable by the piston valve elements 45*f* and 47*f* and a height corresponding to the height of the rods 45*h* and 47*h* of the associated composite cap valve 47 including inner passages 45*b* and 47*b* respectively opened by the piston valve elements 45*f* and 47*f*, such that the valve opening surface inclines upward as it extends in the first direction Y1 and intersects the main scanning direction Y and the up-down direction Z. The valve opening surfaces are not located over the first rods 45*h* or the second rods 47*h*. For example, suppose that the first and second composite cap valves 47 are detached, together with the movable table 41, from the conveyor 50 for maintenance of the cap unit 40. In such a case, the first and second rods 45*h* and 47*h* protruding from the first and second composite cap valves 47 are prevented from being caught by the valve opening surfaces. Thus, the present preferred embodiment facilitates detachment of the movable table 41 from the conveyor 50 and prevents the first and second rods 45*h* and 47*h* from being damaged during detachment of the movable table 41.

Although the preferred embodiments of the present invention have been described thus far, the foregoing preferred embodiments are only illustrative and the present invention may be embodied in various other forms.

In the foregoing preferred embodiments, the printer 1 includes the composite cap valves 47 each including the first and second cap valves 45 that are preferably integral with each other, for example. The printer 1, however, does not necessarily have to include the composite cap valves 47. When the printer 1 includes no composite cap valves 47, each of the cap valves 45 may include: a valve case (not illustrated) including the inner passage 45*b*; the piston valve element 45*f* held in the valve case and movable in the up-down direction Z so as to switch the inner passage 45*b* between the open state and the closed state; the rod 45*h* protruding from the piston valve element 45*f* in the main scanning direction Y and at least partially extending out of the valve case; and the spring 45*j* held in the valve case and defining and functioning as an elastic member to urge the piston valve element 45*f* upward or downward so as to close the inner passage 45*b*. In other words, each of the cap valves 45 may be a valve to switch a single passage between the open state and the closed state. The base 51 may include the right side wall 52 that is a side wall standing vertically or substantially vertically on the end of the base 51 facing in the first direction Y1. The right side wall 52 includes the lifters 52A at locations where the right side wall 52 faces the cap valves 45. Each lifter 52A defines and functions as a valve opening surface that extends between a height corresponding to the height of the rod 45*h* of the associated cap valve 45 including an inner passage 45*b* closable by the piston valve element 45*f* and a height corresponding to the height of the rod 45*h* of the associated cap valve 45 including an inner passage 45*b* opened by the piston valve element 45*f*, such that the valve opening surface inclines upward as it extends in the first direction Y1 and intersects the main scanning direction Y and the up-down direction Z. With the engagement portion 31A in engagement with the movement stopper 41*c*, the carriage conveyor may move the carriage 31 from the second location R2 to the third location R3 (which is located in the first direction Y1 relative to the second location R2) in the first direction Y1. This causes the rods 45*h* to abut against the valve opening surfaces and lifts the rods 45*h* along the valve opening surfaces so as to open the cap valves 45. With the engagement portion 31A in engagement with the movement stopper 41*c*, the carriage conveyor may move the carriage 31 from the third location R3 to the second location R2 in the second direction Y2. This lowers the rods 45*h* along the valve opening surfaces so as to close the cap valves 45. Similarly to the preferred embodiments described above, such an arrangement enables movement of the movable table 41 and opening and closing of the cap valves 45 without providing power to be used exclusively for the cap unit 40.

In the foregoing preferred embodiments, the conveyor 50 moves the movable table 41 in the main scanning direction Y and the up-down direction Z. The conveyor 50, however, may move the movable table 41 in any suitable direction(s). In one example, the conveyor 50 may move the movable table 41 only in the up-down direction Z. In another example, the conveyor 50 may move the movable table 41 in the main scanning direction Y, the up-down direction Z, and the sub-scanning direction X.

In the foregoing preferred embodiments, the right side wall 52 includes the first right side wall 52*d* and the second right side wall 52*u*. The second right side wall 52*u* is connected to the upper portion of the first right side wall 52*d*. The first lifters 52A1 are provided on the first right side wall 52*d* by bending the upper end of the first right side wall 52*d*. The second lifters 52A2 are provided on the second right side wall 52*u* by bending the upper end of the second right side wall 52*u*. The first and second lifters 52A1 and 52A2, however, may be provided in any other manner. In one example, the second lifters 52A2 may be provided by bending the upper end of the right side wall 52 that extends to a height corresponding to the height of the rods 45*h* and 47*h* of the upper composite cap valves 47 in the closed state. In such an example, the first lifters 52A1 may be separate from the right side wall 52 and connected to the right side wall 52 at a height corresponding to the height of the rods 45*h* and 47*h* of the lower composite cap valves 47 in the closed state. Such an arrangement makes it possible to strengthen the right side wall 52 and provide the right side wall 52 and the lifters 52A without increasing the number of components.

The printer 1 may include a cleaner (not illustrated) to wipe the nozzle surfaces of the ink heads 32 and/or clean a member used to wipe the nozzle surfaces. The cleaner may be disposed inside the side cover 15 and leftward of the cap unit 40 such that the cleaner is located side by side with the cap unit 40. Thus, the cleaner performs additional cleaning after suction cleaning. Specifically, the cleaner wipes the nozzle surfaces of the ink heads 32 that have undergone suction cleaning.

In the foregoing preferred embodiments, the printer 1 includes the platen 6, on which the recording medium 8 is to be placed, such that the recording medium 8 is conveyed in the sub-scanning direction X by the grit rollers 16. The printer 1, however, is not limited to such a configuration. In one example, the printer 1 may be a "flatbed printer". The printer 1 may include a table to move the recording medium 8 in the main scanning direction Y and the sub-scanning direction X.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a plurality of ink heads;

an ink head conveyor to move the plurality of ink heads in a main scanning direction, the main scanning direction including a first direction and a second direction opposite to the first direction;

a plurality of caps each being detachably attachable to an associated one of the plurality of ink heads;

a cap conveyor supporting the plurality of caps to move the plurality of caps between a cap attaching position at which the plurality of caps are attached to the plurality of ink heads and a retracted position at which the plurality of caps are detached from the plurality of ink heads;

a plurality of suction devices each provided for an associated one of the plurality of caps;

a plurality of cap valves;

a plurality of first passages each connecting an associated one of the plurality of caps to an associated one of the plurality of cap valves; and a plurality of second passages each connecting an associated one of the plurality of caps to an associated one of the plurality of suction devices; wherein the cap conveyor includes:

a base;

a movable table supporting the plurality of caps;

a support wall standing vertically or substantially vertically on the base, the support wall supporting the movable table such that the movable table is movable between the cap attaching position and the retracted position; and a table urging member to urge the movable table to the retracted position;

the cap conveyor further includes a table wall extending upward from an end of the movable table facing in the first direction, the first direction being a direction extending to the cap attaching position in the main scanning direction; and the plurality of cap valves are disposed on a surface of the table wall facing in the first direction.

2. The inkjet printer according to claim 1, wherein the movable table is made of a single plate; and the table wall is a portion of the single plate that is bent.

3. The inkjet printer according to claim 1, wherein the movable table includes a movement stopper protruding upward; and the ink head conveyor includes:

a carriage retaining the plurality of ink heads;

a carriage conveyor to move the carriage in the main scanning direction; and an engagement portion disposed on the carriage to come into engagement with the movement stopper;

the carriage conveyor moves, with the engagement portion in engagement with the movement stopper, the carriage from a first location to a second location in the first direction so as to move the movable table from the retracted position to the cap attaching position, and moves, with the engagement portion in engagement with the movement stopper, the carriage from the second location to the first location in the second direction so as to move the movable table from the cap attaching position to the retracted position, the second location being located in the first direction relative to the first location.

4. The inkjet printer according to claim 3, wherein each of the plurality of cap valves includes:

a valve case including an inner passage;

a piston valve held in the valve case to move in an up-down direction so as to switch the inner passage between an open state and a closed state;

a rod protruding from the piston valve in the main scanning direction and at least partially extending out of the valve case; and an elastic member held in the valve case to urge the piston valve element upward or downward so as to close the inner passage;

the base includes a side wall standing vertically or substantially vertically on an end of the base facing in the first direction;

the side wall includes valve opening surfaces at locations where the side wall faces the plurality of cap valves;

each of the valve opening surfaces extends between a height corresponding to a height of the rod of the associated cap valve including an inner passage closable by the piston valve element and a height corresponding to a height of the rod of the associated cap valve including an inner passage openable by the piston valve element, such that each of the valve opening surfaces inclines upward as it extends in the first direction and intersects the main scanning direction and the up-down direction;

with the engagement portion in engagement with the movement stopper, the carriage conveyor moves the carriage from the second location to a third location in the first direction so as to cause the plurality of rods to abut against the valve opening surfaces and lift the plurality of rods along the valve opening surfaces, so that the cap valves are opened, the third location being located in the first direction relative to the second location; and with the engagement portion in engagement with the movement stopper, the carriage conveyor moves the carriage from the third location to the second location in the second direction so as to lower the plurality of rods along the valve opening surfaces, so that the plurality of cap valves are closed.

5. The inkjet printer according to claim 1, wherein the plurality of cap valves include first cap valves and second cap valves;

the inkjet printer further comprises composite cap valves each including the first cap valve and the second cap valve integral with each other; and each of the composite cap valves includes:

a composite valve case including a first inner passage and a second inner passage;

a first piston valve element held in the composite valve case to move in an up-down direction so as to switch the first inner passage between an open state and a closed state;

a first rod protruding from the first piston valve element in the main scanning direction and at least partially extending out of the composite valve case;

a first elastic member held in the composite valve case to urge the first piston valve element upward or downward so as to close the first inner passage;

a second piston valve element held in the composite valve case to move in the up-down direction so as to switch the second inner passage between the open state and the closed state;

a second rod protruding from the second piston valve element in the main scanning direction and at least partially extending out of the composite valve case; and a second elastic member held in the composite valve case to urge the second piston valve element upward or downward so as to close the second inner passage.

6. The inkjet printer according to claim 5, wherein each of the plurality of composite valve cases include:

a first cap valve area including the first inner passage, the first piston valve element, the first rod, and the first elastic member; and a second cap valve area including the second inner passage, the second piston valve element, the second rod, and the second elastic member; and the composite valve cases each include a through hole between the first cap valve area and the second cap valve area, the through holes passing through the composite valve cases in the up-down direction.

7. The inkjet printer according to claim 6, wherein the plurality of composite cap valves include at least a first composite cap valve and a second composite cap valve;

the first composite cap valve is disposed on the table wall such that the first composite cap valve is located above the second composite cap valve and out of alignment with the second composite cap valve in a direction perpendicular or substantially perpendicular to the up-down direction;

the first composite cap valve and the second composite cap valve each include a first inlet and a second inlet; and the first passage connected to at least one of the first inlet and the second inlet of the first composite cap valve extends through the through hole of the second composite cap valve.

8. The inkjet printer according to claim 7, wherein the base includes a side wall standing vertically or substantially vertically on an end of the base facing in the first direction;

the side wall includes valve opening surfaces at locations where the side wall faces the first and second rods of the first composite cap valve and the first and second rods of the second composite cap valve;

each of the valve opening surfaces extends between a height corresponding to a height of the plurality of rods of the associated composite cap valve including inner passages closable by the piston valve elements and a height corresponding to a height of the rods of the associated composite cap valve including inner passages openable by the piston valve elements, such that each of the valve opening surfaces inclines upward as it extends in the first direction and intersects the main scanning direction and the up-down direction; and the valve opening surfaces are not located over the first rods or the second rods.

* * * * *